United States Patent [19]

Atkins

[11] 4,038,152

[45] July 26, 1977

[54] PROCESS AND APPARATUS FOR THE DESTRUCTIVE DISTILLATION OF WASTE MATERIAL

[75] Inventor: Lyle D. Atkins, Houston, Tex.

[73] Assignee: Wallace-Atkins Oil Corporation, Houston, Tex.

[21] Appl. No.: 567,193

[22] Filed: Apr. 11, 1975

[51] Int. Cl.[2] ..... C10B 57/02; C10B 47/20

[52] U.S. Cl. ..... 201/2.5; 201/25; 201/27; 201/28; 201/29; 201/30; 201/44; 202/117; 202/128; 202/138; 48/111; 48/209; 48/197 R; 34/159; 34/178; 34/216; 208/102; 196/98

[58] Field of Search ..... 201/2.5, 25, 27, 28, 201/29, 30, 44; 202/117, 128, 138, 151, 116, 230; 48/111, 209, 197; 34/159, 178, 216; 208/102; 196/98; 423/207; 23/262, 277

[56] References Cited

U.S. PATENT DOCUMENTS

| | | | |
|---|---|---|---|
| 1,898,326 | 2/1933 | Wahlstrom | 201/2.5 |
| 2,059,435 | 11/1936 | Brownlee | 23/290 X |
| 2,238,367 | 4/1941 | Mohr et al. | 48/197 |
| 3,020,212 | 2/1962 | Lautz | 202/230 X |
| 3,362,887 | 1/1968 | Rogers | 201/2.5 |
| 3,376,202 | 4/1968 | Mescher | 201/27 X |
| 3,668,077 | 6/1972 | Ban | 201/25 |

*Primary Examiner*—James H. Tayman, Jr.
*Attorney, Agent, or Firm*—Bard, Springs, Jackson & Groves

[57] ABSTRACT

An apparatus is provided for the destructive distillation of organic waste materials. An insulated sealed distillator compartment is provided having a plurality of conveyor stages for transporting the waste material through the sealed compartment while subjecting the material to a plurality of increased zones of temperature in order to completely pyrolyze the material and evolve pyrolysis gases. An auger feed apparatus supplys a continuous supply of material to the sealed distillator, while an auger discharge apparatus removes a continuous supply of solid carbonaceous residue from the distillator. The residue can be classified and separated into usable products. The evolved gases may be converted into crude oil and natural gas. A process for destructive distillation of the waste materials is also disclosed.

30 Claims, 20 Drawing Figures

FIG. 2
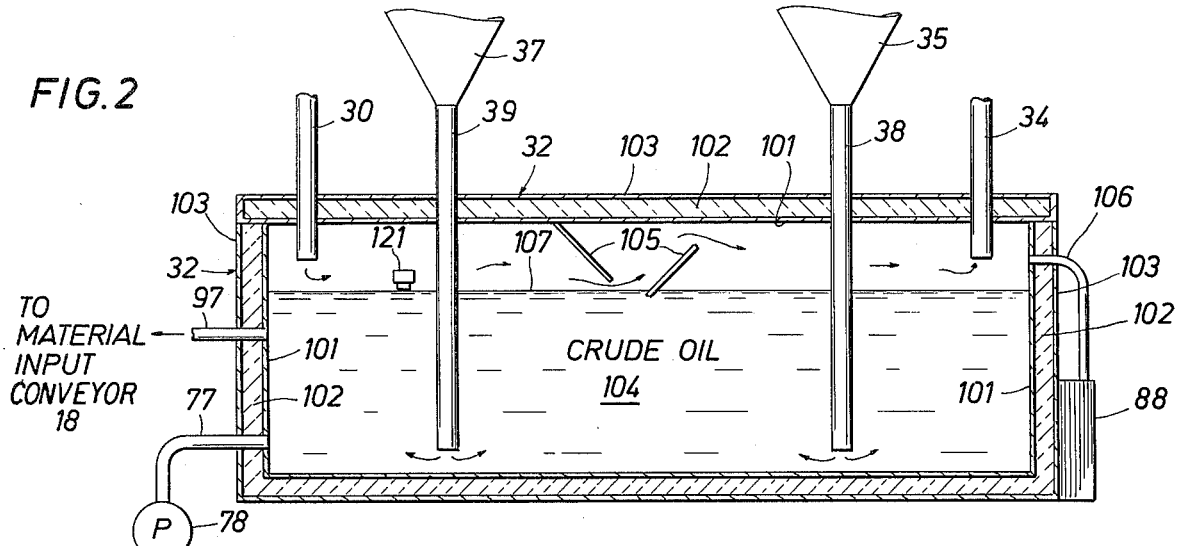
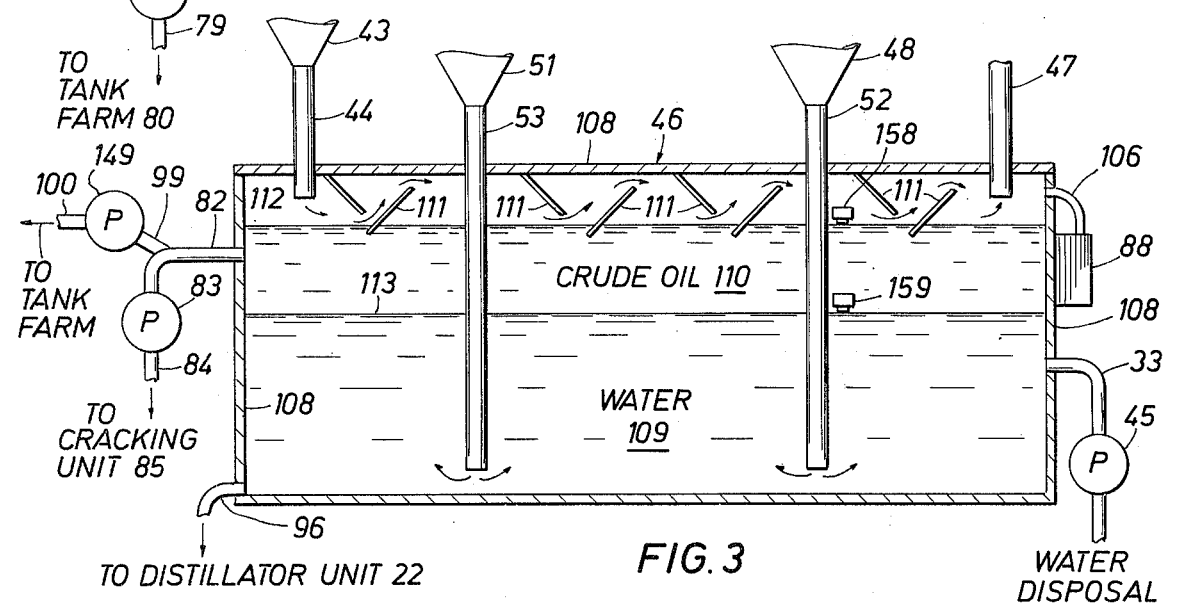
FIG. 3
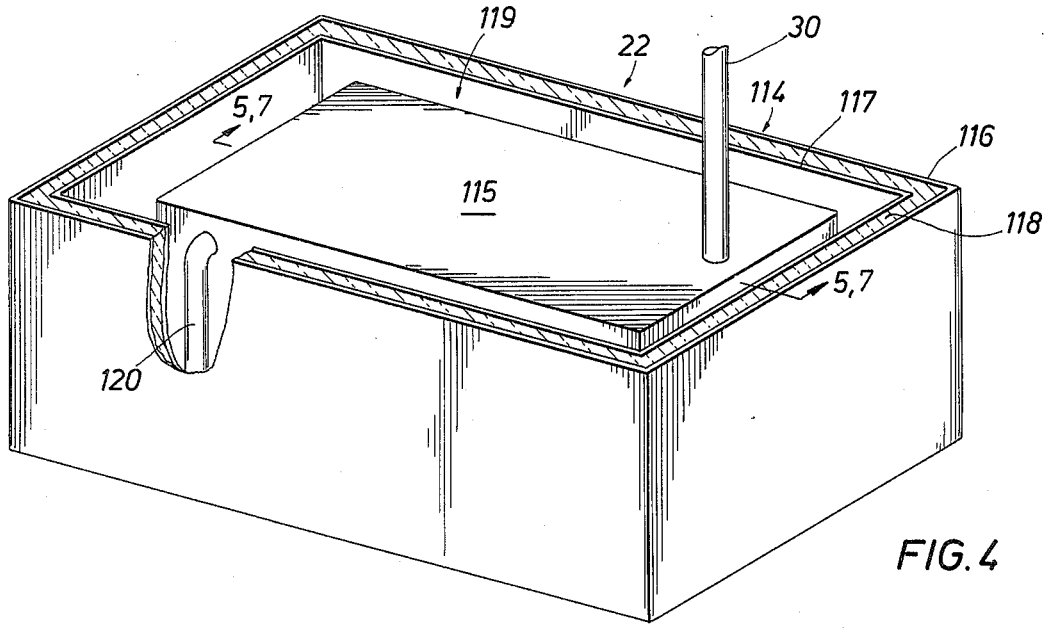
FIG. 4

FIG. 8
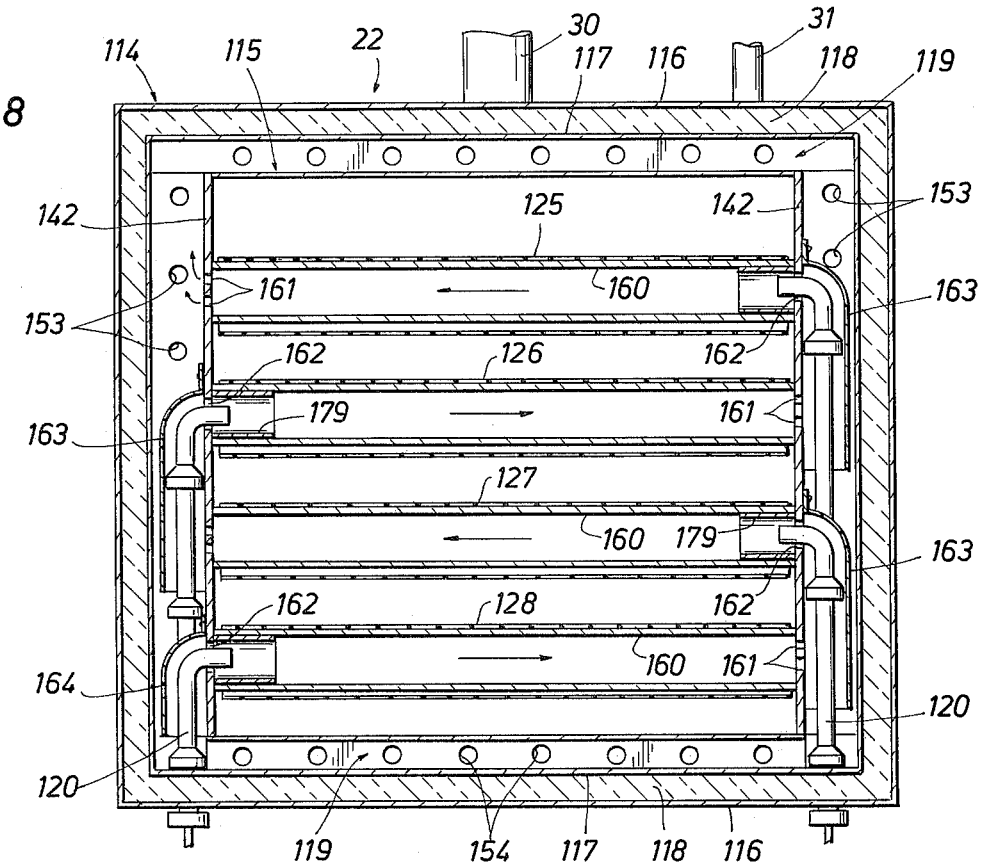
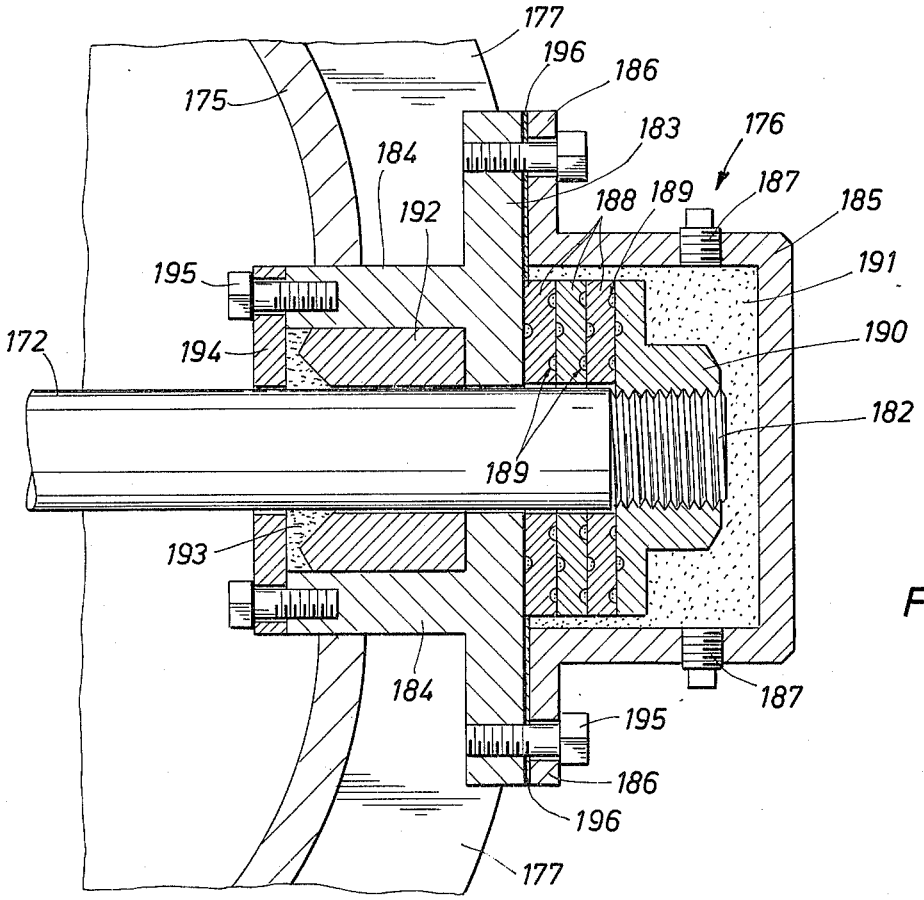
FIG. 13

PROCESS AND APPARATUS FOR THE DESTRUCTIVE DISTILLATION OF WASTE MATERIAL

BACKGROUND OF THE INVENTION

This invention relates to the destructive distillation or pyrolysis of organic waste materials and the recovery of useful products from the residue and evolved gases.

Pyrolysis of organic materials is not a new art. The following United States patents disclose various destructive distillation, pyrolysis or cracking processes and apparatus: U.S. Pat. Nos. 1,777,449; 1,898,326; 2,025,384; 2,160,341; 2,238,367; 2,757,129; 2,897,146; 3,110,663; 3,186,923; 3,207,675; 3,362,887; 3,617,469; 3,639,111; 3,702,039 and 3,761,568. Other materials disclosing pyrolysis systems are the Bureau of Mines Report of Investigations 7428 entitled "Conversion of Municipal and Industrial Refuse into Useful Materials by Pyrolysis," published by the United States Department of the Interior, August 1970.

None of the systems or processes disclosed in the prior art is in commercial use today because of their inefficiency. All of the disclosed systems are "batch" systems, where a "batch" or load of organic material is pyrolyzed and its gases and residue recovered. Then the residue must be removed and a new batch or load of material is then loaded and pyrolyzed. Such batch systems are inherently inefficient since a constant heat cannot be maintained and a constant supply of material cannot be utilized. Further, the prior art systems and processes either require pyrolysis at extremely high temperatures or high pressures or both to operate.

Accordingly, one primary feature of the present invention is to provide a continuous feed distillator for continuously pyrolyzing large volumes of organic materials.

Another feature of the present invention is to provide means to continuously feed organic material into and discharge residue from a sealed distillator for accomplishing the destructive distillation process.

Yet another feature of the present invention is to provide for continuous movement of the material within the distillator under heat sufficient to accomplish pyrolysis of the materials.

Still another feature of the present invention is to provide means for controlling the thickness of the material moving in the sealed distillator in order to maximize heat transfer from the heated distillator to the organic material.

Another feature of the present invention is the classifying and separating apparatus provided for handling and recovering usable products therefrom.

Yet another feature of the present invention is the recovery of crude oil products and natural gas from the gases evolved during pyrolysis.

SUMMARY OF THE INVENTION

The present invention remedys the problems of the prior art by providing apparatus and process for the destructive distillation of organic waste materials wherein the destructive distillation takes place in an insulated atmospherically sealed distillator compartment into which the waste materials are continuously loaded at a predetermined rate, pyrolyzed, and the solid pyrolyzed residue is continuously discharged.

Apparatus is provided for destructive distillation of organic waste materials, the apparatus comprising grinding means for shredding the organic waste materials into pieces of predetermined size, a thermally insulated and atmosppherically sealed distillation compartment having heating means for heating the compartment to a predetermined temperature sufficient to pyrolyze the materials, and a loading conveyor and auger means for continuously supplying the materials to the distillator compartment at a predetermined rate while maintaining the atmospheric seal of the distillator compartment.

The distillator compartment has therein a conveyor means for receiving and continuously moving the materials through the distillator compartment at a predetermined rate and operates in conjunction with distributing means for initially distributing the materials on the distillator conveyor means to a predetermined depth for effecting maximum heat transfer from the distillator compartment to the materials during pyrolysis. The distillator apparatus also includes an auger discharge means for continuously discharging the solid residue of the pyrolyzed materials from the sealed distillator compartment while maintaining the atmospheric seal of the distillator compartment. Classifying, separating and recovering means can also be included to recover charcoal and other carbonaceous materials, ferrous and non-ferrous metals and other solid aggregate materials.

Useful products may be recovered from the gases evolved during the pyrolysis process in the distillator compartment. The gases evolved are first applied to a first cooling means for cooling the envolved gases to condense heavy crude oils while maintaining the gases at a temperature above the boiling point of water. The gases are then catalytically treated to hydrogenate the gases and then applied to a second cooling means to cool the gases to ambient temperature to condense water vapor and other light crude oils. The crude oils are recovered in tanks and the remaining gas is natural gas suitable for industrial use. Means is also provided to maintain the evolved gas pressure in the distillator compartment and cooling means at substantially atmospheric pressures. Heat from the distillator compartment may be used to preheat the waste material before loading into the distillator. The crude oils recovered may be recirculated into the distillator compartment to produce additional quantities of evolved gases. Water recovered from the cooling means may be used to inject into the distillator compartment to gasify the carbonaceous material prior to discharge, further enhancing gas production.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings:

FIG. 2 is a detailed vertical cross-sectional view of the crude oil settling tank shown in FIG. 1.

FIG. 3 is a detailed vertical cross-sectional view of the water settling tank shown in FIG. 1.

FIG. 4 is a fragmentary perspective view of the distillator unit shown in FIG. 1.

FIG. 8 is a detailed vertical cross-sectional view of the embodiment of the continuous feed distillator unit shown in FIG. 7 and taken along lines 8-8.

FIG. 13 is a detailed horizontal cross-sectional view of the auger drive shaft thrust bearing as taken along lines 13—13 of FIG. 12.

DETAILED DESCRIPTION OF THE PREFERRED EMBODIMENTS

Figure 1:
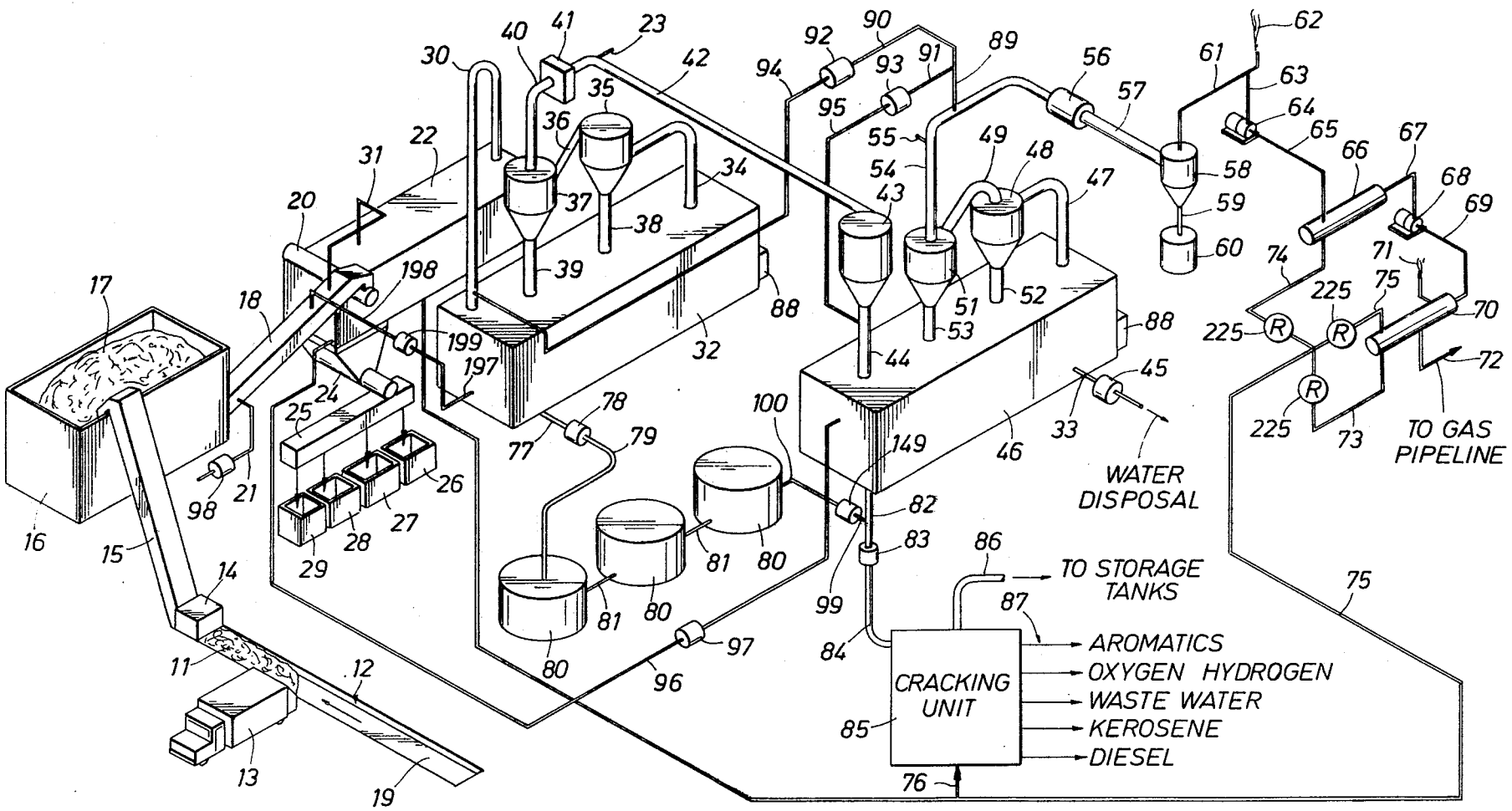
FIG. 1 is a perspective view of the system apparatus for destructive distillation and pyrolysis of organic materials and conversion of the by-products of such materials into hydrocarbon products according to the present invention.

Referring now to FIGS. 1, 2 and 3, the system apparatus and process for destructive distillation and pyrolysis of organic materials and the conversion of evolved gases into liquid and gaseous hydrocarbon products according to the present invention will be explained in detail. Organic waste materials 11, such as trash, garbage, wood, coal, tires, etc., is dumped into a specially designed pit 12 having a continuously moving conveyor system 19 for moving the organic waste material 11 to a conventional grinding apparatus 14 for shredding and grinding the waste material into small, uniform-size pieces for ease of handling and for increasing the heat transfer characteristics of the material. Waste material, as that term is used herein, includes trash, paper, garbage, leaves, grass, plastic, textiles, wood, rubber, tires, coal or any other materials containing carbonaceous materials. Such wastes often also contain glass, ferrous and non-ferrous metals and other inorganic solids. Typically, the grinder 14 shreds and grinds the waste materials into pieces that are 4-inches or smaller in size. The shredded material is then transported by means of a conveyor 15 and discharged into a storage tank 16 for storing the materials prior to being placed in the distillator unit for processing. The ground and shredded waste materials 17 are transported from storage tank 16 by a sealed conveyor system 18 where the materials are discharged into an intake auger unit 20 which compresses the waste material and discharges it into the distillator 22. Distillator 22 is a continuous feed unit having multiple conveyor levels, as will be hereinafter described in further detail, for handling the ground and shredded waste materials while they are being heated in the absence of oxygen, a process more commonly referred to as "pyrolysis" or "destructive distillation." Such destructive distillation or pyrolysis evolves gases heavily laden with oxygen, water vapor, hydrogen, and other forms of hydrocarbon gases at temperatures up to 1,000° F.

The evolved pyrolysis gases generated by the destructive distillation of the waste materials in the continuous feed distillator 22 are directed through pipe 30 as the input to a crude oil settling tank, which will be hereinafter further described in detail. After the waste materials have been pyrolyzed within distillator 22, the remaining solid carbonaceous by-products and other materials are discharged into a discharge auger means 24 and applied to a classifying and separating means 25 where the solid pyrolyzed by-products are cooled, classified and separated into charcoal which is discharged into container 26, into ferrous metals which are discharged into a separate container 27, into non-ferrous metals which are discharged into a separate container 28, and into other aggregate materials which are separately deposited into yet another container 29. These classified and separated materials may then be collected and further processed, or sold as raw materials for the making of new products.

Figure 20:
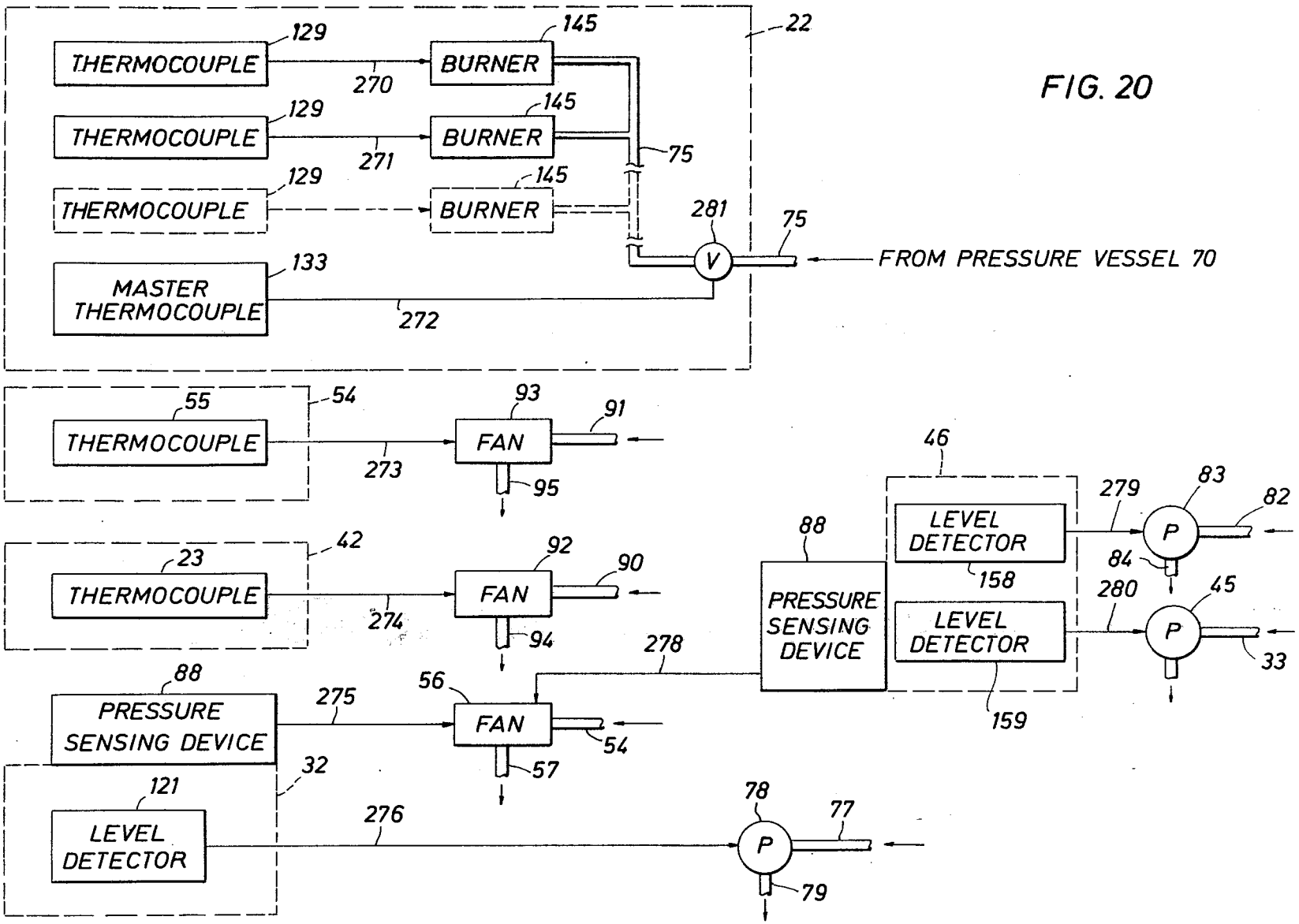
FIG. 20 is a schematic representation of basic control apparatus and circuitry of the system shown in FIG. 1.

The crude oil settling tank 32 of FIG. 1 is shown in greater detail in a vertical cross-sectional view in FIG. 2. Referring now to FIGS. 1, 2 and 20, the crude oil settling tank 32 comprises an inner metal tank 101, an outer metal shell or tank 103, and a layer or section of thermal insulation 102 disposed therebetween. A quantity of crude oil 104 is placed into settling tank 32 to a predetermined level 107 that immerses the ends of discharge pipes 38 and 39, from cyclones 35 and 37, respectively, that will be hereinafter further described. The ends of pipes 30 and 34 terminate above the level 107 of crude oil 104 to allow the hot pyrolysis gases from distillator 22, arriving via pipe 30, to travel across the surface 107 of crude oil 104 and around the baffle plates 105 to be discharged via pipe 34. To maintain the crude oil 104 at its desired level 107, as detected by level detector 121, crude oil may be removed from tank 32 by means of piping 77 and 79 and pump 78 for storage in storage tanks 80, as shown in FIG. 1. Level detector 121 controls the operation of pump 78 by sending a control signal through conductor 276.A pipe 106 connects the interior of tank 32 above level 107 and a pressure sensing or measuring device 88, for measuring the pressure of the hot gases within the crude oil settling tank 32, for purposes that will be hereinafter further described. Crude oil 104 may also be applied through piping 197 and 198 and pump 199 to be combined with waste material 17 in conveyor unit 18.

Referring now to FIGS. 1 and 2, the hot gases from distillator 22 are applied into crude oil settling tank 32 by means of pipe 30. The hot gases travel across the surface 107 of crude oil 104, and around baffle plates 105, and exit through pipe 34. The hot gases enter the crude oil settling tank 32 at approximately 1,000° F. and the tank is thermally insulated to maintain the temperature of the gases within the crude oil settling tank 32 at temperature above 214° F. The gases are cooled traveling from pipe 30 to pipe 34 within the crude oil settling tank 32, and heavy crude oil and other hydrocarbon condensates condense into tank 32. Since the temperature in crude oil settling tank 32 is maintained at above 214° F., any water vapor in the pyrolysis gases remains in a vapor form and does not condense into tank 32.

It is desired to maintain the pressure of the evolved pyrolysis gases throughout the system at atmospheric pressure, and, accordingly, a pressure sensing or measuring means 88 samples the gas pressure within tank 32 and controls pressure equalizing means 56, that will be hereinafter further described, if the pressure begins to build up within tank 32. Pressure sensing or measuring means 88 may be any conventional pressure measuring means such as a conventional manometer. The cooled pyrolysis gases will be discharged from crude oil settling tank 32 through pipe 34 and applied to series-connected cyclone units 35 and 37, interconnected by pipe 36, for separating fly ash from the gases. The fly ash and any other crude oil condensates are discharged from cyclones 35 and 37 by means of pipes 38 and 39, respectively, where the fly ash and crude oil condensate products are deposited into the crude oil settling tank 32.

The pyrolysis gases are discharged from cyclone 37 through pipe 40 to a conventional catalyst reactor 41 for producing additional hydrogenation of the hydrogen, oxygen and hydrocarbon gases in the pyrolysis gas stream. Catalyst reactor 41 will be hereinafter further described in greater detail. The hydrogenated pyrolysis gases leaving reactor 41 are applied through pipe 42 as an input to a cyclone unit 43 which functions as a condenser for cooling the pyrolysis gases and discharges the gases through pipe 44 into the water settling tank 46. The temperature of the gases in pipe 42 is measured by a thermocouple 23. The thermocouple 23 controls the recirculation of cooler gases to tank 32 if the temperature at the thermocouple rises above a predetermined value about 214° F.

The construction and function of the water settling tank 46 will now be described in greater detail, referring to FIGS. 1, 3 and 20. The water settling tank 46 is a sealed tank having sides and top 108 and containing a plurality of pairs of baffles III located adjacent the top of the tank 46. Water 109 is initially placed in tank 46 to immerse the ends of discharge pipes 52 and 53, from cyclones 48 and 51, respectively, as shown. The water 109 is maintained at a predetermined level 113 by means of a water discharge pipe 33 and water discharge pump 45 which discharges the water 109 to a suitable water disposal means. Discharge pump 45 may be controlled by level detector 159 by sending a control signal through conductor 280. The water level may also be controlled by returning water 109 through pipe 96 by means of pump 97 to the distillator unit 22 for adding to the hot pyrolyzed carbonaceous materials in the distillator 22 for gasifying the carbonaceous materials, thereby enhancing the recovery of pyrolysis gases for use in the process. Crude oil 110 is introduced into the settling tank to a level 112 and maintained at level 112 by means of level detector 158 and pumps 83 or 149 and pipes 82 and 84, or 99 and 100, respectively, for transferring the crude oil either to a tank farm 80 as shown or to a cracking unit 85 for purposes that will be hereinafter explained. Level detector 158 controls pump 83 by sending a control signal via conductor 279.

The hot gases and condensates discharged from cyclone 43 through pipe 44 enter the space above crude oil level 112 in tank 46 and travel a circuitous route around the plurality of baffles III for additional cooling for causing water and lighter crude oils to condense in tank 46 and separate into the water layer 109 and the lighter crude oil layer 110. The gases enter tank 46 at about 212° F., and the cooled gases leave tank 46 through discharge pipe 47 and are applied as an input to a cyclone unit 48. Further cooling of the gases occurs and additional water vapor and other lighter oils condense and are discharged from cyclone 48 through pipe 52 into tank 46. The remaining gases from cyclone 48 are discharged through pipe 49 to a second cyclone unit 51. The pyrolysis gases applied to cyclone 51 are further cooled and additional lighter crude oils condense and are discharged through pipe 53 into the water settling tank 46 as shown.

The pyrolysis gases discharged from cyclone 51 are applied through piping 54 and 57 and an in-line fan 56 to the intake of a cylone unit 58. Further condensates from cyclone 58 are discharged through pipe 59 to a container or tank 60. The condensate in tank 60 will be some water and lighter ends of the liquid hydrocarbon spectrum. The function of the in-line fan 56 will be hereinafter further described. The remaining pyrolysis gases discharged from cyclone 58 comprise natural gas suitable for industrial use and are applied through piping 61 and 63 to a first compressor stage 64. The gas is compressed by compressor 64 and pumped to a pressure vessel 66 through piping or tubing 65. The first stage compressor 64 compresses the gas to a pressure of approximately 200 p.s.i. If the compressor 64 is not able to handle the gas from cyclone 58, the gas may be flared as shown at 62. The output of pressure vessel 66 is applied through piping 67 to the second compressor stage 68 where the gas is compressed to a yet higher pressure and applied to a second pressure vessel 70 through piping 69. The pressure in pressure vessel 70 may be approximately 700 p.s.i., or any other desired pressure, such as local gas pipeline pressure if it is desired that the gas be transported by pipe to users for industrial or other purposes. The gas may be applied from pressure vessel 70 through piping 72 to a pipeline, or other processing or handling equipment. Gas for purposes of firing the cracking unit 85 and for firing the furnaces to heat the distillator 22 may be obtained from pressure vessel 70 through piping 75 and regulator 225. In addition, compression of the gas in the pressure vessels 66 and 70 will form liquid petroleum gas, LPG, which is higher in BTU content than the natural gas. This LPG may be vaporized and returned to piping 75 for use in the process by passing the LPG from tanks 66 and 70 through piping 74 and 73 and regulators 225, respectively, into pipeline 75.

The lighter crude oils 110 recovered in water settling tank 46 may be discharged through piping 82 and 84 by means of pump 83 to a conventional cracking unit 85, utilizing heat from burning gas obtained from pressure vessel 70 by means of piping 75 and 76, to further crack the lighter crude oils 110 into the following outputs 87 from the cracking unit 85: aromatics, including gasoline, benzene and alcohol, oxygen, hydrogen, waste water, kerosene, diesel and others. Any crude that is not converted by the cracking unit 85 may be discharged through piping 86 to appropriate storage tanks (not shown).

As hereinabove described with regard to FIGS. 1 and 2, the crude oil settling tank 32 and water settling tank 46 have associated therewith a pressure sensing means 88 for sensing the gas pressure within the respective tanks. If the gas pressure builds above a predetermined value within tank 32 or 46, pressure sensing means 88 controls the operation of the in-line fan 56, hereinabove previously mentioned. The control of fan 56 by pressure sensing means 88 is done by conventional electrical control means, and no electrical wiring is actually shown in FIG. 1. FIG. 20 shows a simplified schematic of certain control functions. Pressure sensing device 88, associated with tank 32, is connected with fan 56 by means of conductor 275. Pressure sensing device 88, associated with tank 46, is connected with fan 56 by means of control conductor 278. When in-line fan 56 is turned on, it draws gases through the system through pipe 54 and discharges the gases through pipe 57, thereby reducing the pressure in the system upstream of fan 56. Fan 56 continues to run until a predetermined pressure value is reached in tanks 32 or 46. Once the predetermined value has been reached in crude oil settling tank 32 or water settling tank 46, it is sensed by pressure measuring device 88 which controls the operation of fan 56, and turns the fan off when the desired pressure is attained.

As hereinabove described, it is desired to maintain the gas temperature in tank 32 above 214° F. Accordingly, a thermocouple 23 is inserted in pipe 42 to measure the temperture of the gases discharged from cyclone 37 and reactor 41. If the temperature rises above a predetermined level above 214° F. at thermocouple 23, then thermocouple 23 signals in-line fan 92 through control conductor 274 (see FIG. 20) and turns the fan "on" to recirculate cooler gases from downstream in the system back into pipe 30 for cooling the gases in tank 32. Similarly, thermocouple 55 is disposed in pipe 54 to monitor the temperature of the gases leaving cyclone 51 of tank 46. If the gas temperature at thermocouple 55 rises above a predetermined value above the desired 60°–90° F. range, then thermocouple 55 switches on in-line fan 93 via conductor 273. Fan 93 recirculates cooler downstream air back into discharge pipe 44 of cyclone 43 to cool the temperature of the gas in tank 46. Once the gas temperature reaches the desired value, thermocouple 55 switches "off" fan 93. To maintain the desired temperature range in tank 46, approximating ambient atmosphere temperature, tank 46 may also have to be insulated like tank 32 in order to prevent the gases from reaching a too low temperature in extremely cold weather or climates.

Referring now to FIG. 4, the distillator 22 is shown, in exaggerated simplified form, as comprising two main elements, an outer insulated distillator housing 114 and an inner box or housing 115 where the continuous feed destructive distillation or pyrolysis action takes place. The outer insulated housing 114 is separated from the inner housing 115 by a heated air space 119, as will hereinafter be further described. Outer insulated housing 114 comprises an outer shell 116 and inner tank or shell 117 with a thermal insulation like asbestos or spun wool 118 therebetween. A furnace stack 120 is shown disposed in air space 119 and providing heat to the interior of the inner housing 115. The flue pipe 30 carrying the evolved pyrolysis gases is shown extending from housing 115. The top of the outer insulated housing 114 is closed also and provides a heated air space between the top of housing 115 and the insulated top of outer housing 114.

Figure 5:
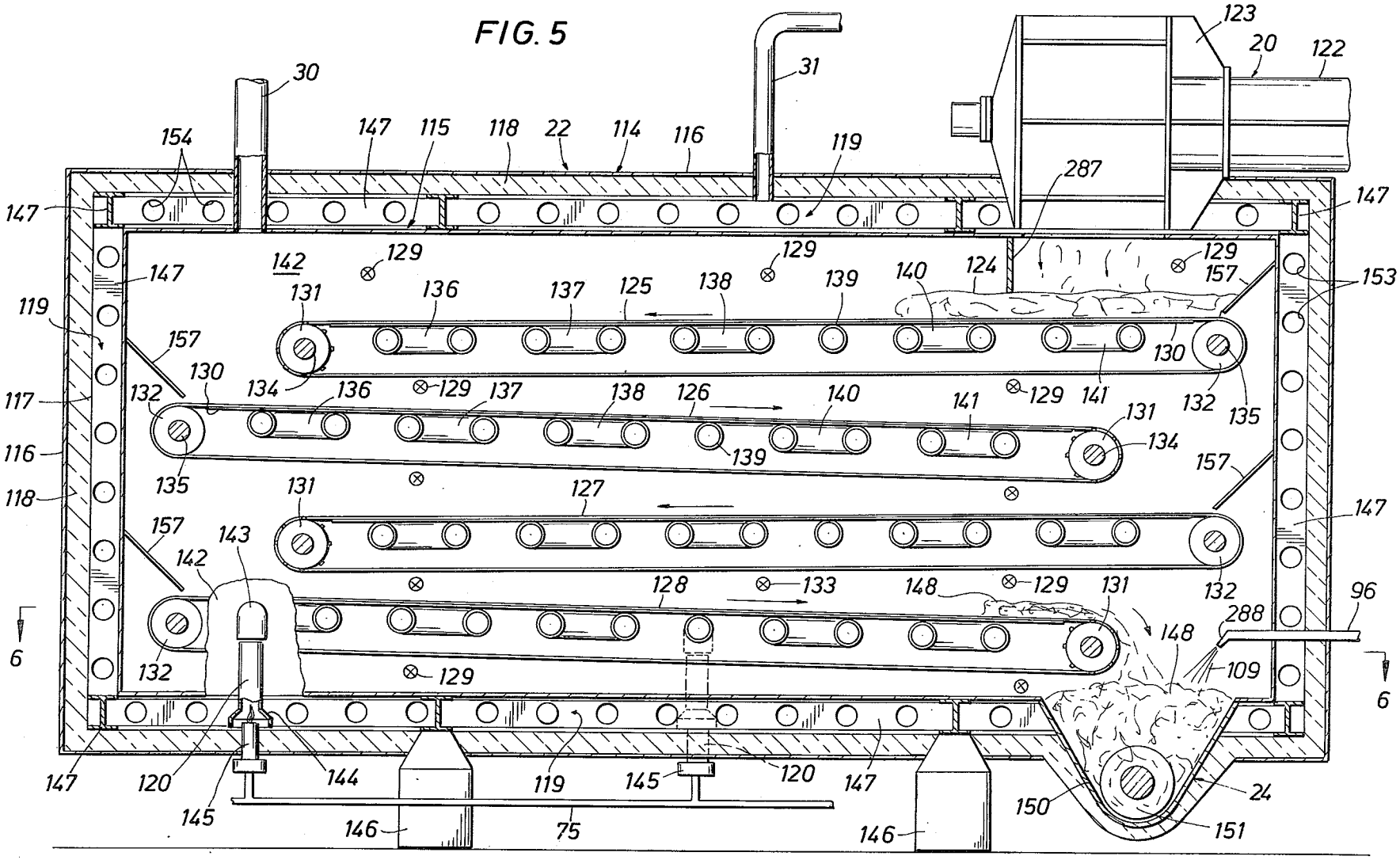
FIG. 5 is a detailed vertical cross-sectional view of one embodiment of the continuous feed distillator unit taken along lines 5—5 of FIG. 4.
Figure 6:
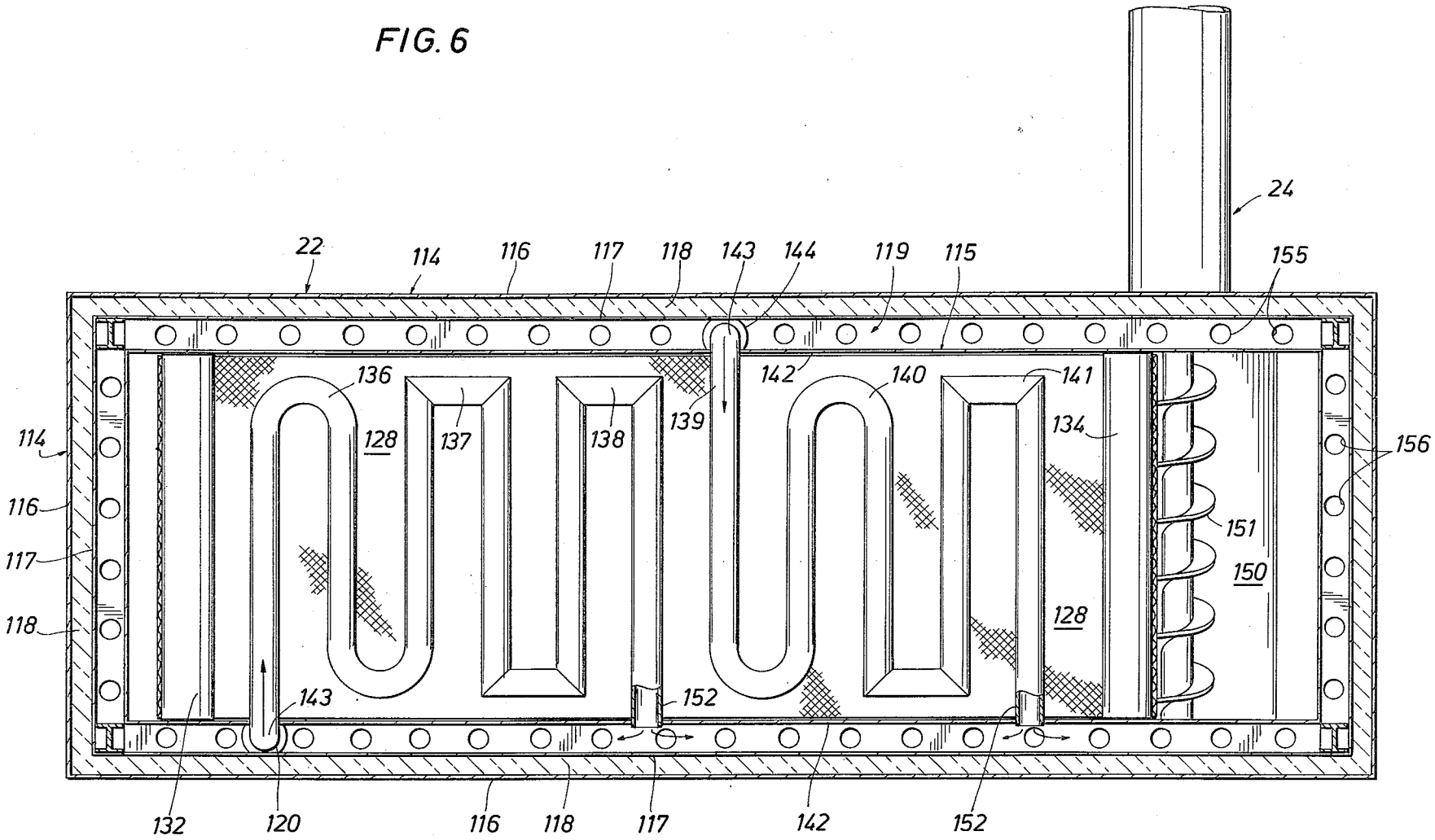
FIG. 6 is a detailed horizontal cross-sectional view of the embodiment of the continuous feed distillator unit as taken along lines 6—6 of FIG. 5.
Figure 7:
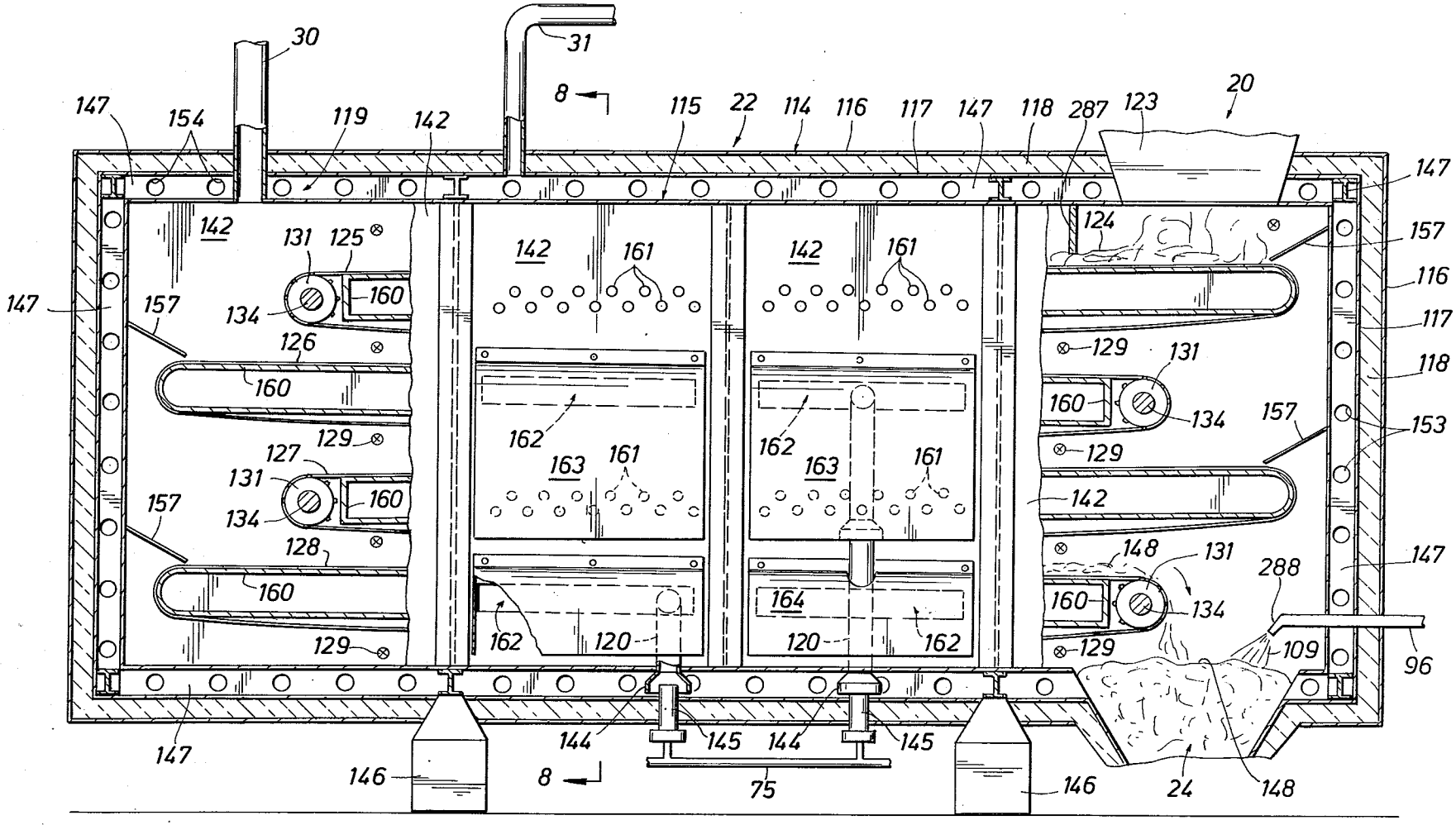
FIG. 7 is a detailed cross-sectional view of a second embodiment of the continuous feed distillator unit as taken along lines 7—7 of FIG. 4.

FIG. 5 is a vertical cross-section of one embodiment of the distillator 22 taken along lines 5—5 of FIG. 4. The outer housing 114 comprises an outer steel jacket 116, an inner steel jacket 117, and a layer of asbestos or other high temperature thermal insulation 118. The inner housing 115, comprising a steel plated jacket, is spaced from the outer housing inner jacket 117 by means of steel beams 147. The beams 147 have circular holes 153 and 154 drilled therein, and the holes 153 and 154 and the space between the beams 147 defines the hot air space 119 shown diagrammatically in FIG. 4. The distillator is structurally supported by columns 146.

Within inner housing 115 are disposed four chain-link conveyors 125, 126, 127 and 128, the upper surface of each of which is defined by a conveyor pan 130 over which the chain-link conveyor moves. Each conveyor 125, 126, 127 and 128 is driven by a drive sprocket 131 mounted on a conveyor drive shaft 134. The other end of each conveyor rolls over on idler wheel 132 turning on an idler shaft 135. The drive shafts 134 are driven by suitable conventional drive means (not shown), such as variable speed electric motors and gear trains for driving the conveyors at a predetermined speed. The four conveyors are staggered longitudinally as shown in order that waste material is transferred from each conveyor beginning at the upper level and progressing to the lower level. The intake auger 20 carrying the waste material discharges the material into the auger discharge section 123 where the waste material 124 is dumped onto pan 130 and the chain link conveyor 125 adjacent the idler end of the conveyor. A baffle 157 prevents the waste material 124 from falling over the end of conveyor 125. Material 124 is conveyed along pan 130 of conveyor 125 until it reaches the drive sprocket end of conveyor 125 where it is dumped onto pan 130 of conveyor 126, travelling in the opposite direction from the direction of travel of conveyor 125. Material 124 travels along conveyor 126 until it reaches the sprocket end 131 of conveyor 126, whereupon the material is dumped from conveyor 126 to conveyor 127 traveling in the opposite direction again. The same action is repeated and the material 124 travels along conveyor 127 until it is dumped onto conveyor 128 travelling in the opposite direction. The material 124, now pyrolyzed in accordance with the heating procedure hereinafter to be further defined, comprises a carbonaceous material 148 which is dumped into the discharge hopper 150 to be discharged through discharge auger 24 as will hereinafter be described in greater detail. Baffles 157 are spaced adjacent each loading end of the conveyors 126, 127 and 128 similar to the baffle 157 spaced adjacent the loading end of conveyor 125 as above described.

Referring now to FIGS. 5, 6, 9 and 10, to heat the waste material 124 in the distillator 22, one embodiment utilizes a series of hot air ducts or pipe sections located within enclosure 115 and disposed in horizontal rows in contact with each of the conveyor pans 130 for each conveyor 125, 126, 127 and 128 for heating the conveyor pans and the space within the distillator enclosure 115. One level of the heating duct or pipe comprises an input elbow or pipe 143 and successively joined U-shaped pipe sections 136, 137 and 138, and terminating in discharge pipe 152 for forming a first heating coil doubling back and forth across the width of the distillator for each conveyor section. A second heating coil comprises input pipe 139 and successively joined U-shaped pipe sections 140 and 141, terminating in discharge pipe 152. Heat is supplied to the heating coils by means of burner stacks comprising one or more heating pipe sections 120 having a bell-shaped end 144, and a burner element 145 receiving gas for combustion from gas pipeline 75. The burner stack pipe sections 120 are located in the heated air space 119, and the discharge pipes 152 discharge the heated air into space 119 for circulation around the inner container or envelope 115 of the distillator. As may be seen in greater detail in FIGS. 9 and 10, the burner stacks may comprise a plurality of heating pipe sections 120. The bell-shaped hub end 144 is spaced from the other end of a preceding pipe section 120 and the venturi effect of the hot combustion gases from burner 145 passing through the heat pipes 120 draws already heated air from space 119 through the air space in the bell-shaped hubs 144, thus causing a continuous circulation of air through the air space 119, through the heat pipes 120 and the first and second heating coils (as hereinbefore defined) to heat the conveyor pans 130 of each conveyor 125, 126, 127 and 128 and to maintain a desired air temperature in the hot air heating space 119 surrounding the inner enclosure 115 of distillator 22. Pipe 31 communicates with the hot air space 119 and hot air is circulated through pipe 31 to the sealed conveyor system 18 to preheat the waste material, as will hereinafter be further described.

It is desired to maintain the conveyor pan 130 and the air immediately adjacent conveyor 125 at a temperature of approximately 650° F. Similarly, conveyor 126 is maintained at approximately 800° F., conveyor 127 at 900° F. and the lower conveyor 128 at approximately 1,000° F. Thermocouples 129 are disposed above and adjacent each conveyor 125–128 to monitor the temperature in the immediate vicinity of each conveyor. As may be seen in FIG. 20, the thermocouples 129 control burners 145 for maintaining the heat in the area of each conveyor uniformly to the approximate values hereinabove given. Temperature signals are transmitted from the thermocouples 129 through conductors 270, 271, et seq., to burners 145 to control the burner operation and increase or decrease the necessary heat applied to distillator 22. A master control thermocouple 133 is located above and adjacent the lowest conveyor 128 to monitor the temperature and guard against overheating the distillator. Master thermocouple 133 is connected to a master gas control valve 281 by means of a conductor 272 (see FIG. 20). If the temperature as monitored by master thermocouple 133 rises above a predetermined safe level, the temperature signal from thermocouple 133 is applied to valve 281 via conductor 272, and valve 281 is actuated to shut off the gas flow through line 75 to burners 145 and stopping all heating action of the distillator until the overheating problem can be corrected.

In operation, burners 145 are fired and hot air is circulated through the heating ducts associated with each conveyor 125–128, and in the hot air space 119 until the desired heat ranges for each conveyor are attained, as hereinabove described. The preheated waste material 124 is discharged from the intake auger 20 and is dropped on the moving conveyor 125 adjacent its idler end. As the conveyor 125 transports the material 124 away from the area of the discharge chute or hopper 123, the material 124 is evenly distributed over the conveyor to a depth not greater than approximately 8 inches by a breaker bar 287. As the eight-inch layer of material is transported along conveyor 125 the heat in enclosure 115 penetrates the waste material 124 and heats it to the temperature range being maintained for conveyor 125. Since the waste material is only approximately eight inches thick, and heat is being applied uniformly to the waste material from all sides, the heat only has to penetrate a maximum thickness of approximately four inches of material, thus providing rapid maximum heat transfer from the heat in the distillator to the waste material 124. This rapid heat transfer to the material assures uniform heating of the material for maximum efficiency of the destructive distillation and pyrolysis process.

The material 124 is transported along conveyor 125 and then dumped at the driven end onto the next lower conveyor 126 where the material 124 is subjected to the next higher temperature level, as hereinabove described. Conveyor 126 dumps the material at its driven end onto the next lower conveyor 127 where the material is subjected to the next higher temperature level. Conveyor 127 dumps the material 124 at the conveyor's driven end onto the lowest conveyor level 128, where the material is subjected to the highest heat level.

As the material is heated in the sealed distillator enclosure 115, in the absence of a supply of oxygen, combustion of the waste material does not occur. However, the water content of the materials is vaporized, and the tars, oils and other volitalizable components of the material are also vaporized, leaving as a final residue 148 at the driven end of conveyor 128, dry solids such as cinders, ash and charcoal as the remains of organic materials and the remains of all other inorganic material such as metals, glass, etc. The residue 148 is dumped from conveyor 128 into the intake hopper 150 of discharge auger 24 where it is moved by auger 151 to clasifying and separating means 25 (see FIG. 1) for separation into usable component materials, as will hereinafter be further described. As the material 124 chars in the destructive distillation and pyrolysis process, ash is formed on the surface of the material and tends to act as in insulator. However, the movement of the material by the chain link conveyor as it slides over a respective pan 130 helps agitate the material, and the gravity transfer of the material from one conveyor to another acts to mix and redistribute the materials as they are transferred from one conveyor to another. In addition, the dumping of the materials in transfer from one conveyor to another further acts to break off loose ash and char from the surface of the material, thereby further exposing unpyrolyzed material to the maximum heat transfer. With the temperatures above described being maintained in the distillator, it has been found that a conveyor speed of approximately three feet per minute will be sufficient to pyrolyze most waste materials in the distillator 22. Of course, the speed can be varied to change the pyrolysis rate of various materials used as feedstock. With the three-foot per minute conveyor speed above described, the material will spend about 20–25 minutes in the distillator before the residue is discharged. This time can, of course, be varied by varying the speed of the conveyor as above described.

The vapors and gases evolved during the destructive distillation and pyrolysis process are collected and channeled to the remaining system through pipe 30, for reclaiming usable crude oil, tar, natural gas and other products, as hereinbefore described. To gasify coal, charcoal, char or ash, and to increase the BTU content of the recovered natural gas, water 109 may be recirculated into distillator 22 through pipe 96 and sprayed through nozzle 288 over the carbonaceous materials as they are dumped from the lower conveyor 128. Some of the crude oil may be recycled and added into the waste material in conveyor 18 to be vaporized again in distillator 22, as will hereinafter be further explained. Recycling crude oil in this manner enhances the production of natural gas in the distillator. The inner envelope 115 of distillator 22 is sealed, and the intake and discharge auger systems are sealed in order that all evolved gases and vapors will be retained and channeled through discharge pipe 30.

Advantages of the distillator 22, herein described, are:

1. Continuous feed system handles more material.
2. Material is spread out only eight inches deep, thus allowing more efficient heat transfer.
3. Material is ground before pyrolysis to insure no particles over four inches, therefore enhancing heat transfer.
4. Multiple controlled heat areas for maximum effectiveness.
5. A sealed system including intake and discharge.
6. Material is agitated and turned over four times during the pyrolysis process to aid in heat transfer and eliminating ash and char from the unpyrolyzed material.
7. Can recycle crude oil into distillator to obtain more evolved natural gas.
8. Can inject water and steam to gasify coal, charcoal, char and ash for recovering additional hydrocarbon vapors.

The catalyst reactor 41 may be employed to hydrogenate the evolved gas stream as it passes through the reactor. The volatile vapors react with the catalyst material to cause a hydrogenation reaction in the constituent vapor products in the evolved gas stream. Among the various catalysts that may be employed are finely divided metals such as nickel, iron, copper, chromium, tungsten, and molybdenum, as well as various alloys of these metals. The oxides of metals such as nickel oxide, iron oxide, copper oxide, as well as various other compounds and substances generally known to function as hydrogenation catalysts may be used.

Referring now to FIGS. 7, 8, 9 and 10, a second emobdiment of the distillator 22 is shown. The outer envelope 114 and the inner shell or envelope 115 are identical to those hereinabove described for the first embodiment. Similarly, the conveyors 125–128 and the location of thermocouples 129 and 133 are identical to the conveyors and thermocouples previously described, except for the construction of the conveyor pans and the heat ducts through the inner envelope 115. In the second embodiment the conveyor pans are the upper surface of an elongated metal box 160 inserted within the circumference of each chain link conveyor 125–128. The interior of each box 160 communicates with the hot air space 119 between outer and inner envelopes 114 and 115 by means of intake slots 162 and discharge ports 161. Heat shields 163 and 164 are utilized on each side 142 of the inner envelope 115 to help trap and channel hot air into the intake slots 162.

Figure 9:
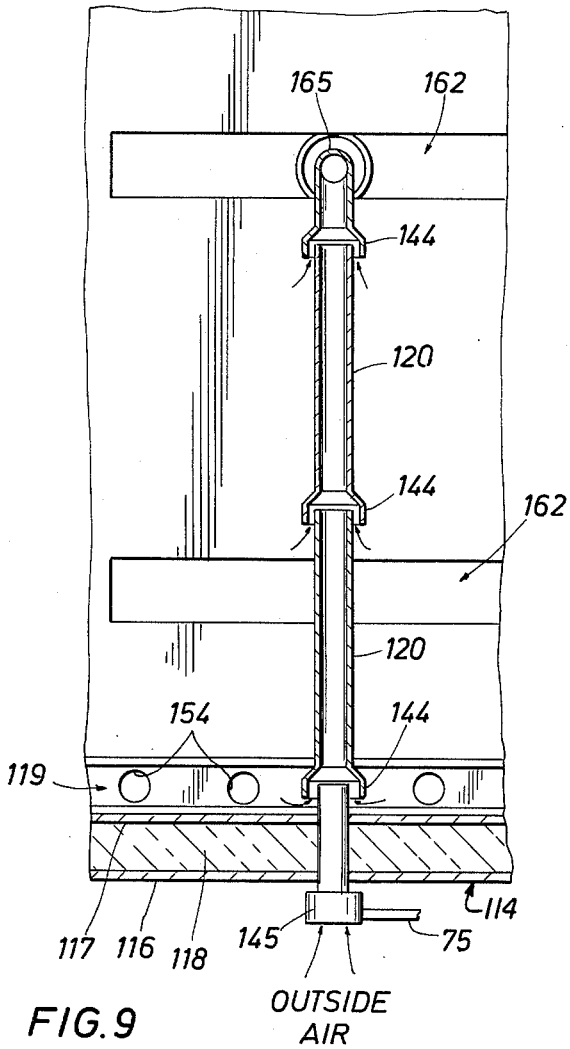
FIG. 9 is a detailed fragmentary vertical cross-sectional view of a typical furnance burner stack used in the continuous feed distillator unit.
Figure 10:
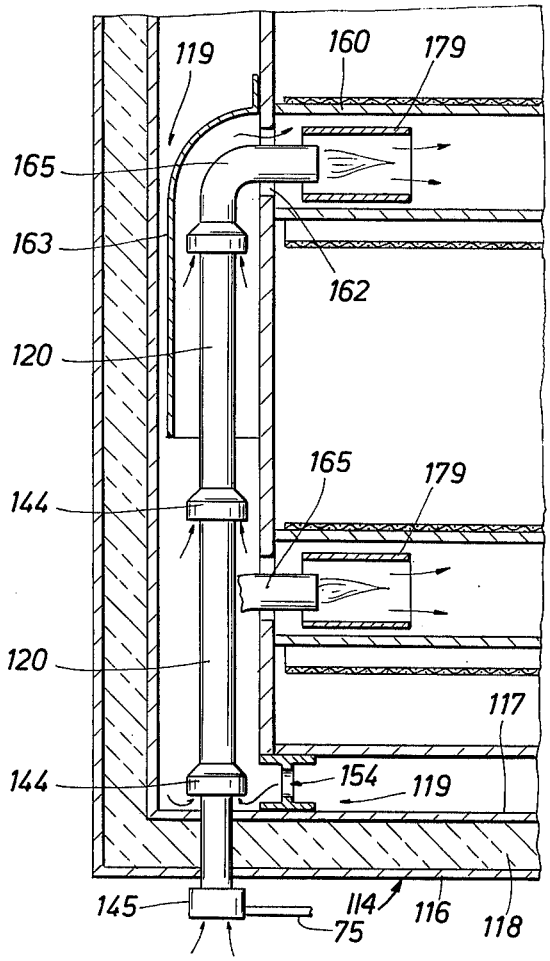
FIG. 10 is another detailed fragmentary vertical cross-sectional view of a typical furnace burner stack used in the continuous feed distillator unit.

The burner stacks for this embodiment of the distillator 22 are shown in more detail in FIGS. 9 and 10. The burner element 145 is connected to gas line 75 and penetrates outer envelope 114 into the air space 119. A heating pipe section 120 is positioned with its bell-shaped hub 144 encircling the exposed end of burner 145 to accept the combustible elements of the burning gas and direct then upwardly to other pipe sections 120, if needed. An elbow section 165 is provided to channel the hot combustion gases into the slot 162 and into box 160 for heating the associated conveyor area 125–128. A sleeve 179 is placed in box 160 to act as a deflector for the hot combustion gases and prevent their impinging directly on the surfaces of box 160.

In operation, burner element 145 draws outside air through ports in its base to provide the oxygen to support combustion of the gas from line 75. The jet of combustible gases flowing through pipes 120 and 165 creates a venturi effect which draws heated air in air space 119 into each pipe section 120 through holes 144 and through slot 162 to create a circulation of air through the heated air space 119. The flow of hot air through the envelope 115 is more clearly seen in FIG. 8, where the heated air input is on opposite sides of each successive box 160, the heat deflectors 163 and 164 acting to create a "series" arrangement whereby the hot air flows through the lower box 160 in one direction, then back through the next higher box in the opposite direction, then through the third box in the same direction as the lowest or first box, and then reversing direction for the upper box to be discharged through ports 161 into space 119.

Other than the structural differences hereinabove described in the second embodiment of distillator 22, all other operating parameters such as temperature, conveyor speed, control, the pyrolysis process, intake of waste material and discharge of residue are identical to that previously described for the first embodiment.

The distillator 22 is preferably constructed of high grade steel. The burner pipes 120, 143, and 165, and sleeve 179 are preferably cast iron. The heater ducts shown in the first embodiment are preferably stainless steel to withstand direct contact with the high temperature combustion gases. Of course, other materials having a high temperature capability may be used. A distillator capable of handling 100 tons of waste material a day would measure ten feet high, six feet wide and 28 feet in length and handle approximately 3,800 pounds of material at one time.

Figure 11:
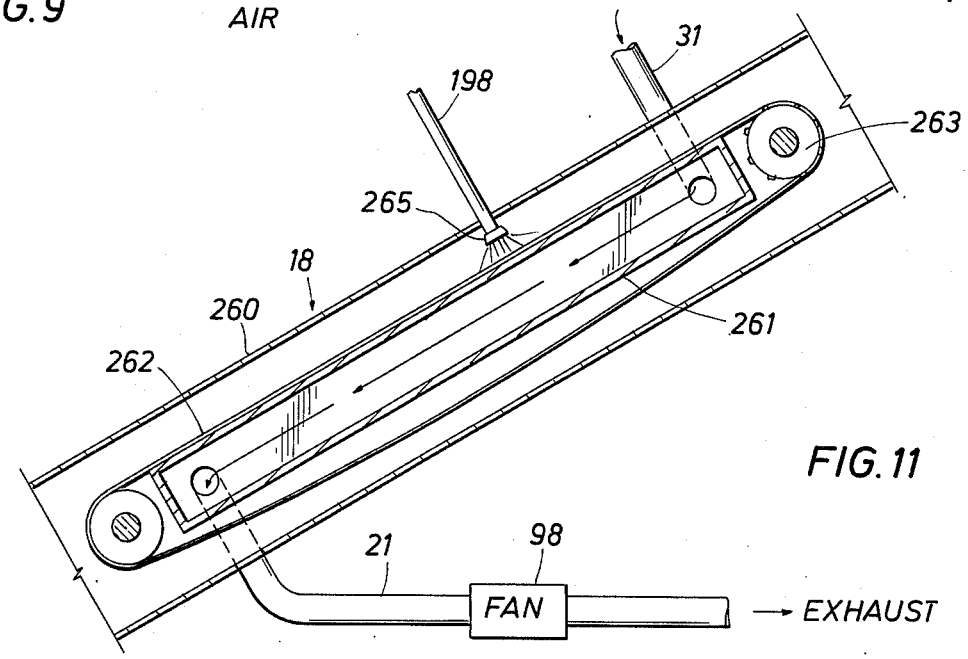
FIG. 11 is a partial vertical cross-sectional view of the sealed conveyor unit transferring the organic materials from the storage tank to the intake auger of the distillator unit.

The preheating of the waste material 17 in conveyor unit 18 is more particularly shown in FIG. 11. Referring to FIGS. 1 and 11, the material 17 is transported by a conveyor 262 housed in a sealed housing 260 from the base of the storage bin 16 to the intake auger 20. Disposed within the circumference of conveyor 262 and contacting the surface of the conveyor carrying the material is a sealed metal box 261 through which heated air from space 119 of distillator 22 is circulated by means of pipe 31 and discharge pipe 21. Preheating the material increases the efficiency of the pyrolysis process and is especially useful in cold climates where the feedstock material 17 may be at a very low temperature or even frozen. The temperature in the conveyor unit 18 should never reach the boiling point in order to prevent the vaporization of water. If the temperature rises above a predetermined level, fan 98 can be switched on to evacuate the heated air from box 261, thereby cooling the air in box 261.

In addition, as previously mentioned, crude oil from tank 32 can be recirculated and applied to the waste material in conveyor unit 18 for vaporization in distillator 22 to ncrease the production of natural gas. Crude oil from tank 32 is circulated through pipes 197 and 198 by pump 199 and applied to a nozzle 265 for spraying the oil uniformly over the waste material 17 transported by conveyor 262. The material will absorb much of the crude oil and be carried into the distillator 22 with the preheated material 124 in the same manner as hereinbefore described.

Figure 12:
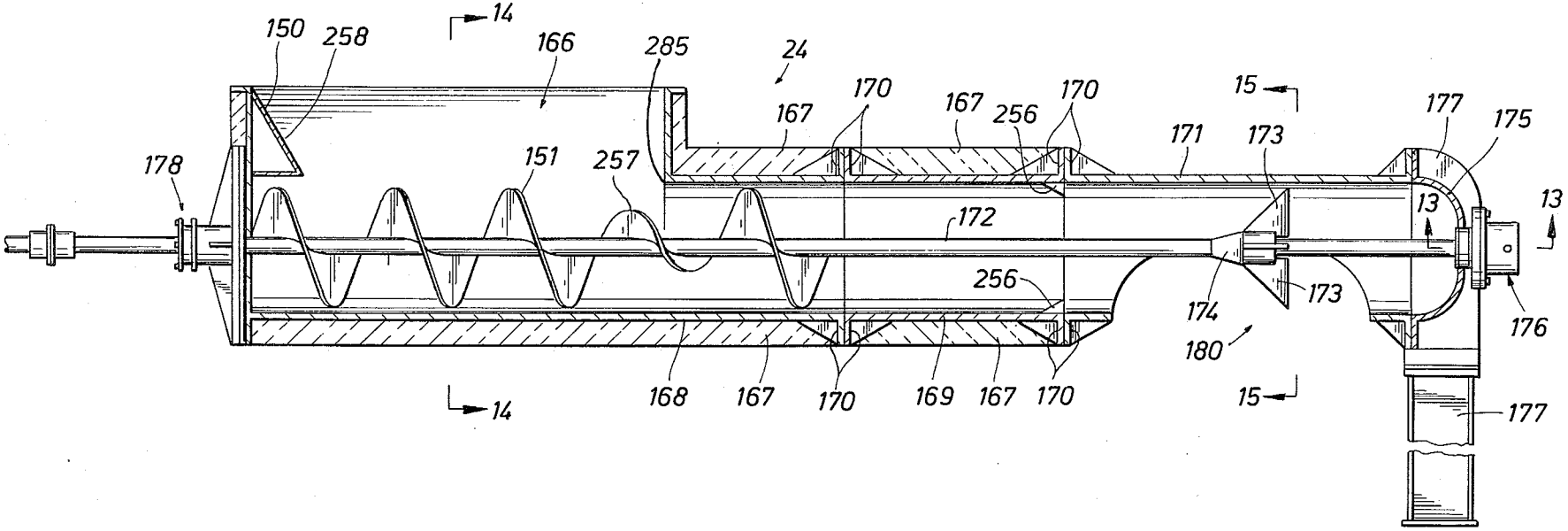
FIG. 12 is a detailed vertical cross-sectional view of the intake or discharge auger means according to the present invention.
Figure 15:
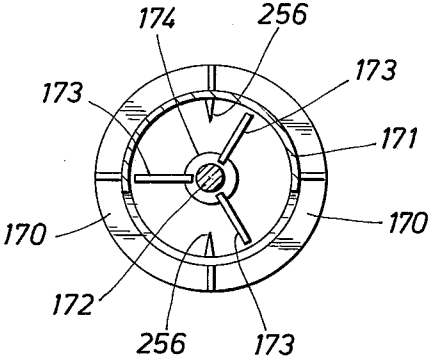
FIG. 15 is a detailed vertical cross-sectional view of the discharge section of the auger means as taken along lines 15—15 of FIG. 12.
Figure 14:
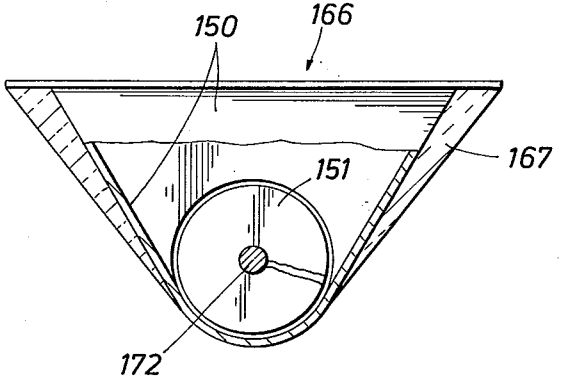
FIG. 14 is a detailed vertical cross-sectional view of the intake section of the auger means as taken along lines 14—14 of FIG. 12.

The intake and discharge auger units 20 and 24 may be described with reference to FIGS. 12-15. The auger unit 24 shown in FIG. 12 is the discharge auger unit 24 that accepts the discharge residue from distillator 22. However, the basic construction of the intake auger 20 is almost identical except the intake and discharge hoppers are modified and, therefore, only the discharge auger 24 will be described is detail. The auger unit 24 comprises an intake section 168, a gas seal section 169, and discharge and end sections 171 and 175. The intake section comprises a cylindrical auger housing 168 having a V-shaped intake hopper 150 for defining the auger intake opening 166. The outer surface of section 168 is covered with a thermal insulating material 167 to prevent heat transfer from the material in hopper 150 to the outside air. An auger blade 151 mounted on a drive shaft 172 is disposed axially in the cylindrical portion of section 168. The drive shaft 172 extends through a sealed drive bearing 178 to a source of power (not shown) for rotating the auger shaft. Auger blade 151 is reduced in diameter at 257 adjacent shoulder 285 of the hopper 150 to prevent jamming of larger pieces of material between the auger blade 151 and hopper shoulder 285. The auger blade 151 returns to its normal diameter inside of the cylindrical portion of section 168 and terminates just adjacent the end of section 168. A deflector 258 is provided in hopper 150 to prevent material from jamming between the end of auger blade 151 and the hopper housing 150.

Gas seal section 169 is a cylindrical section also having an insulated outer surface 167. Gas seal section 169 is attached to section 168 by conventional fastening means (not shown) attached to radial flanges 170 on the mating ends of sections 168 and 169. The material from the auger section 168 is tightly packed into section 169 where it is compressed into such a dense mass that the packed cylindrical plug of material acts as a natural gas seal and seals the intake opening 166 from the discharge opening 180. To prevent the tightly packed cylindrical material plug from rotating with drive shaft 172 as it leaves gas seal section 169, stabilizing bars 256 having knife edges bite into the seal plug and prevent the plug from rotating as it is fed into the discharge section 171.

Discharge section 171 is cylindrical in configuration and closed on one end by end section 175. End section 175 is shown supported by a column 177. Discharge section 171 has a discharge opening 180 through which the material is discharged. In the case of auger unit 24, the material discharged through opening 180 is discharged into the classifying and separating unit 25, while in auger unit 20, the material discharged through opening 180 is discharged into the distillator unit 22. Discharge section 171 is attached to gas seal section 169 by means of conventional attaching means (not shown) utilizing mating radial flanges 170 of each section 169 and 171. Attached to drive shaft 172 is a cutter blade hub 174 centrally located in opening 180. Fixed to the hub are three radially extending cutter blades 173. The hub 174 and blades 173 rotate with shaft 172. As the packed material plug is fed into discharge section 171 from gas seal section 169 it moves axially along shaft 172 until it encounters the rotating hub 174 and cutter blades 173. As the material plug encounters hub 174 it is spread open and the rotating cutter blades 173 engage the end of the material plug and break it up into pieces corresponding to the material size as fed into the intake section 168. The descharge through the auger is continuous as long as the input is continuous.

The idler end of drive shaft 172 is disposed in a specially designed thrust bearing 176, which may be seen in greater detail in FIG. 13. End section 175 has a flange 177 through which the drive shaft 172 protrudes. A thrust bearing hub 184 integral with a hub plate 183 is axially disposed over the threaded end 182 of shaft 172 and fixed to flange 177 and end section 175 by suitable attaching means, such as welding. The threaded end 182 of shaft 172 extends beyond hub plate 183. Flat disc washers 188 having annular grooves in each flat face are disposed between the hub plate 183 and a retaining nut 190 threaded on the threaded end 182 of shaft 172. The grooved spaces 189 are filled with a graphite grease for lubrication. A thrust bearing cover 185 is placed over washers 188, nut 190 and the end of shaft 172 and fixed to the hub base 183 by means of bolt 195 inserted through flanges 186 of the bearing cover 185. A seal 196 of suitable material is disposed between flange 186 and hub base 183. The thrust bearing cover 185 interior space is then filled with a graphite 191 to lubricate the washers and nut 190. Grease 191 may be injected or removed from the interior of cover 185 through openings provided by plugs 187. A cylindrical cast iron bearing 192 is disposed axially about shaft 172 within hub 184. An annular bearing seal 193 comprising asbestos fibers and graphite is disposed axially about shaft 172 adjacent bearing 192. Bearing 192 and seal 193 are retained within hub 184 by means of an annular hub seal cover 194 attached to hub 184 by means of bolts 195. The washers 188 are preferably made of stainless steel to withstand the forces exerted on shaft 172 and to withstand the temperatures encountered. Nut 190 may be of cast iron.

The forces acting on shaft 172 are directed from the threaded end 182 toward the driven end. Thus the nut and washers are placed in compression against hub base 183, and great frictional forces are generated. The direction of the threads on end 182 is such that, as the shaft 172 rotates, the nut is self-fastening, thus keeping the washers 188 in compression. The thrust bearing 176 described above is capable of withstanding the auger loads developed in packing the material in gas sealing section 169.

Figure 16:
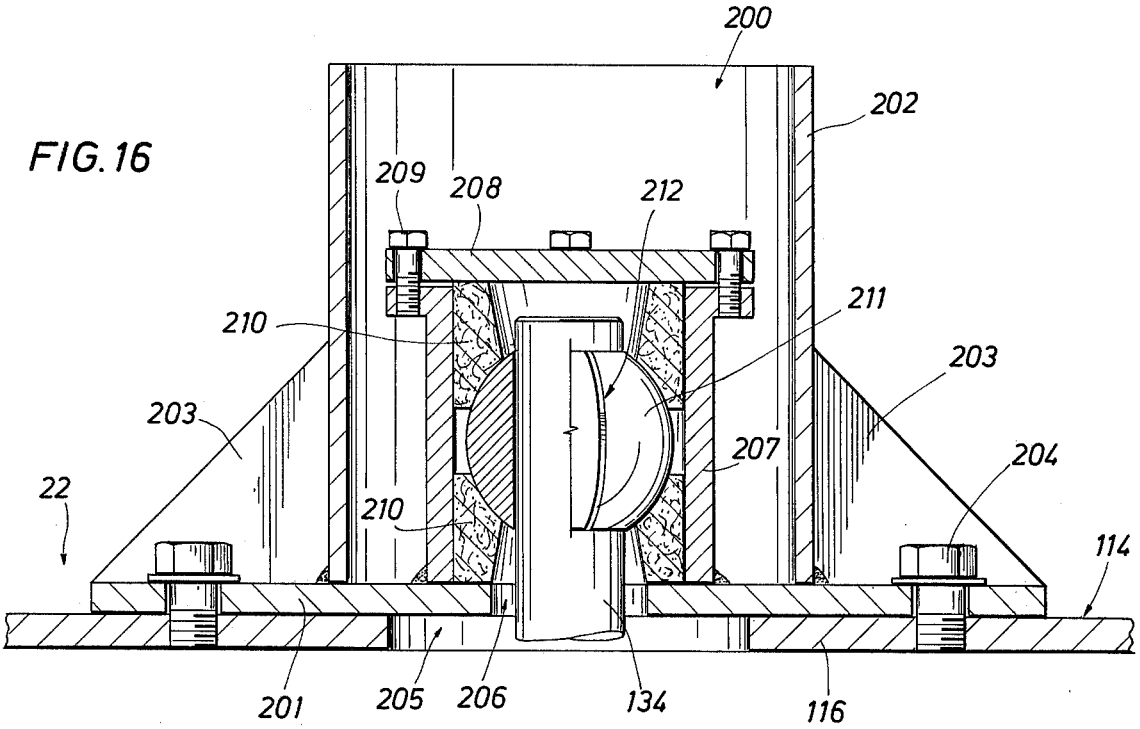
FIG. 16 is a detailed horizontal cross-sectional view of the distillator unit conveyor drive shaft idler bearing.

FIG. 16 shows details of the idler bearing for one of the drive shafts 134 of the conveyors in distillator 22. The outer envelope 114 has a steel plate wall 116 with an opening 205 therein for accepting the idler end of drive shaft 134. Bolted over opening 205 is a base plate 201 having an opening 206 for accommodating the end of shaft 134. A cylindrical bearing shield 202 is welded coaxially about opening 206 to plate 201 and is supported by flanges 203. A cylindrical bearing hub 207 is welded to plate 201 coaxially encircling opening 206 and shaft 134. A spherical bearing 211, having a split groove 212 is slipped over the end of shaft 134 and is supported within bearing hub by cylindrical bearing sleeves 210. The bearing hub 207 is closed by a hub plate 208 bolted to hub 207 by means of bolts 209. Bearing 211 is made of cast iron, and the split groove 212 is for purposes of expansion due to the heat radiated from distillator 22 through openings 205 and 206, and conducted through shaft 134. Cylindrical bearings 210 are constructed of asbestos fibers impregnated with graphite. Such a bearing unit will withstand the extremely high temperatures generated in distillator 22.

Figure 17:
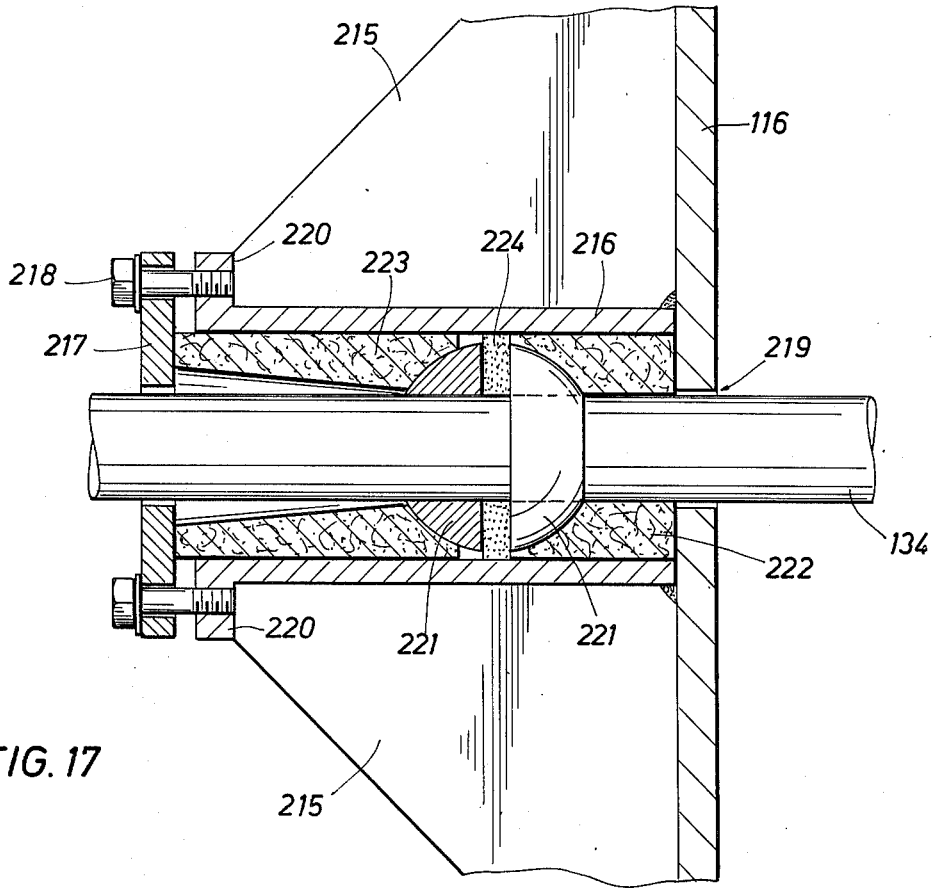
FIG. 17 is a detailed vertical cross-sectional view of the distillator unit conveyor drive shaft or auger drive shaft bearing adjacent the torque input end of the shaft.

FIG. 17 illustrates a sealed drive bearing for use in the high temperature environment of a conveyor drive shaft 134 of distillator 22. The outer steel plate 116 of the distillator 22 has an opening 219 therein to accommodate shaft 134. A cylindrical bearing hub 216 is coaxially disposed about drive shaft 134 and welded to plate 116. Hub 216 is supported by flanges 215. Disposed axially about shaft 134 are a pair of hemispherical bearings 221 with an asbestos and graphite packing ring 224 disposed between them. Bearings 221 are supported within hub 216 by means of a pair of cylindrical bearing sleeves 222 and 223. Bearing sleeve 223 extends beyond the end of hub 216 and contacts a bearing plate 217. Bearing plate 216 is attached to radial flanges 220 of hub 216 by means of bolts 218. By tightening bolts 218, pressure is exerted by plate 217 against the end of bearing sleeve 223 and against bearings 221 and sleeve 222. Bearings 221 are suitably constructed of cast iron, and bearing sleeves 222 and 223 are preferably constructed of asbestos and graphite. Exerting pressure on bearing sleeve 223 exerts pressure on bearings 221 and sleeve 222 and compresses packing seal 224 and bearing sleeve 222 to help seal hub 216 to shaft 134 and prevent gas escape from the interior of distillator 22. The asbestos bearing sleeves 222 and 223 are able to withstand the high temperature environment of the distillator 22.

Figures 18, 19:
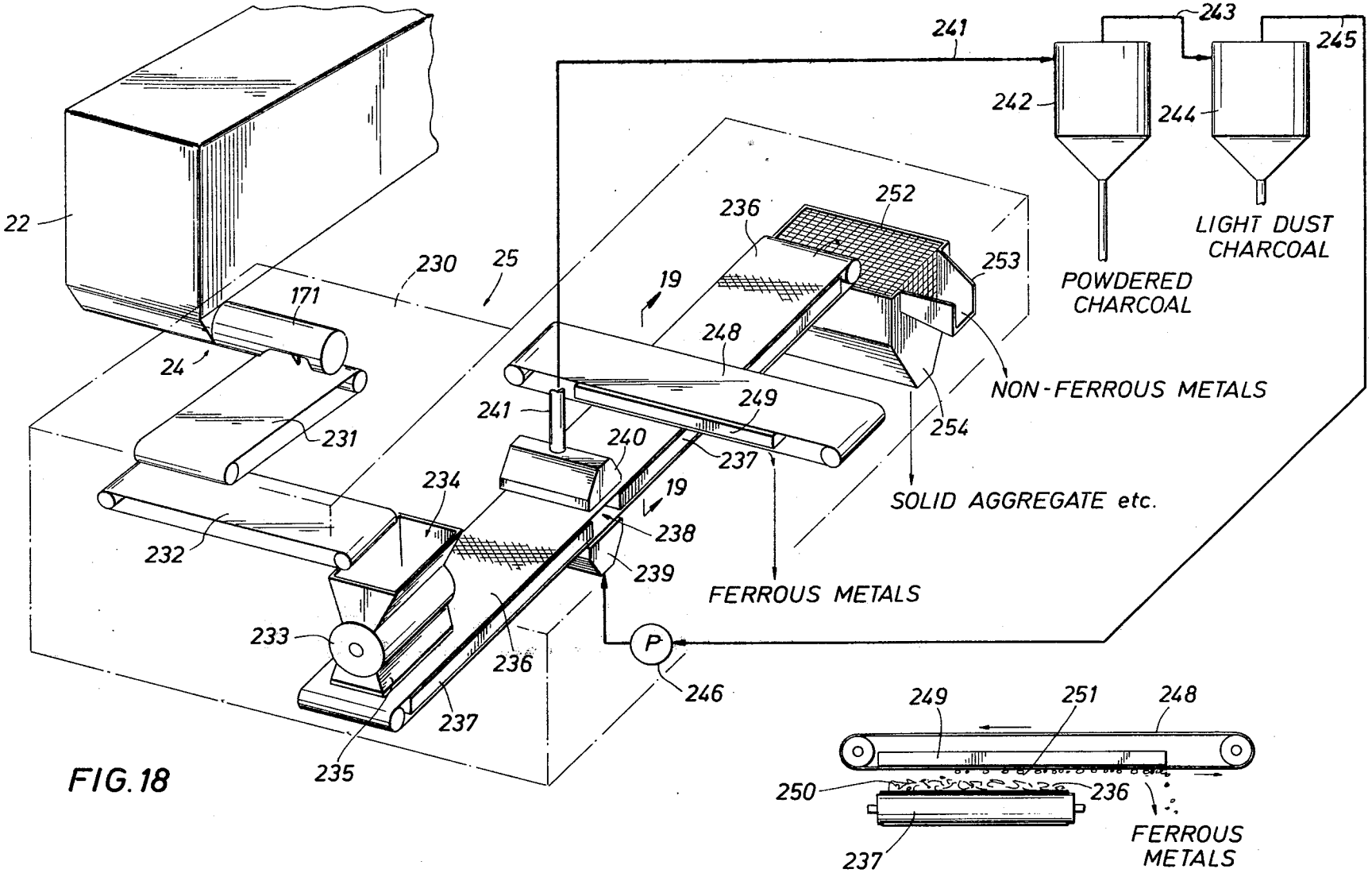
FIG. 18 is a simplified perspective and schematic view of the distillator discharge material classifying and separating means.
FIG. 19 is a simplified vertical cross-sectional view of the ferrous metals separating means as taken along lines 19—19 of FIG. 18.

Referring now to FIGS. 18 and 19, the classifying and separating means 25 will be explained in detail. The residue is discharged from distillator 22 into discharge auger unit 24 and then discharged from the discharge section 171 into a slow moving conveyor 231 which dumps the residue onto another conveyor 232. Conveyors 231 and 232 function to spread out the residue discharged from auger 24 and allow it to cool. The residue carried by conveyor 232 is dumped into the intake 234 of a hammermill 233 where the organic material residue is ground into pieces of the size of one inch or smaller, while larger metal pieces are discharged without change in size. The milled residue is discharged from screens 235 of hammermill 233 onto a conveyor 236 along with the metal pieces.

Conveyor 236 has a conveyor belt constructed of a porous nylon or other wear-resistant fabric or a porous fabric woven of a non-ferrous metal material such as brass. The conveyor 236 has a pan 237 disposed within its circumference, the pan having an opening 238. Below the opening 238 and conveyor 236 is disposed a discharge air duct 239. Above opening 238 and conveyor 236 is disposed an intake air duct 240. A fan 246 blows an air stream through piping 245 into duct 239, through the porous fabric of conveyor 236 and opening 238, and into duct 240 to lift all light ash, dust and small pieces of charcoal which are entrained in the air stream and delivered through pipes 241 and 243 to at least a pair of series connected cyclones 242 and 244 to separate out charcoal particles and lighter charcoal dust and powder which are recovered and may be utilized as raw materials in making other products. The air stream from cyclone 244 is returned via pipe 245 to close the system at fan 246.

The remaining residue 250 continues along conveyor 236 until the residue passes under a transverse conveyor 248 spaced above conveyor 236. A permanent magnet 249 is disposed within the conveyor 248 and adjacent the conveyor belt surface facing conveyor 236. As residue 250 passes under conveyor 248, the ferrous metal particles 251 are separated by magnetic action from residue 250 and are transported along conveyor 248 away from conveyor 236. As the conveyor belt 248 passes the end of permanent magnet 249, the ferrous metal particles 251 fall from conveyor 248 into a collection bin (not shown). The remaining residue on conveyor 236 is transported to a conventional vibrating and/or rotating screen 252 where the larger residual non-ferrous metal particles are screened out and are discharged through hopper 253 to a suitable collection bin (not shown). The remaining solid residue from conveyor 236 is essentially non-organic aggregate materials such as sand, glass, small rocks and the like. The solid aggregate materials are discharged from screen 252 through hopper 254 for collection. All of the above materials may be further processed or utilized in the production of other products.

Numerous variations and modifications may obviously be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. A process for destructive distillation of waste material containing organic matter, comprising the steps of shredding the waste material into pieces of predetermined size, continuously supplying said shredded materials to a sealed distillator compartment at a predetermined rate, distributing said shredded material to a uniform predetermined depth for movement through said distillator compartment, continuously moving said shredded material along a plurality of superposed generally horizontal paths through said sealed distillator compartment at a predetermined rate, uniformly heating said shredded material along each of said superposed generally horizontal paths to a predetermined range of temperatures during vertical movement of said material through said distillator compartment to pyrolyze said shredded material, controlling said temperature in said distillator compartment to about 650° F at a highest vertical level and at selectively increasing temperatures to about 1000° F at a lowest vertical level, pyrolyzing said continuously moving materials for evolving volatile gases and vapors from said organic matter in said waste material, continuously discharging the solid residue of said pyrolyzed organic waste materials from said sealed distillator compartment, treating said residue discharged from said distillator compartment to separate said solid residue into charcoal and other carbonaceous products produced by pyrolyzing said organic matter, metals and other non-ferrous aggregates originally contained in said waste material, continuously removing said evolved gases and vapors from said sealed distillator compartment, maintaining said distillator and said evolved gases at atmospheric pressure, cooling said removed gases for condensing a portion of said gases into liquid petroleum products and water, recovering said condensed water and liquid petroleum products, and recovering the remaining evolved gases.

2. The process as described in claim 1 wherein the step of treating said solid residue further comprises the steps of shredding said solid residue as said residue is discharged from said sealed distillator compartment, removing charcoal and other light particulate material from said solid residue, passing the remaining residue through a magnetic field to remove ferrous metals, and collecting the remaining non-ferrous aggregate at the end of said treatment.

3. The process described in claim 1, wherein said cooling step includes cooling said evolved gases to condense heavy crude oils while maintaining the gases at a temperature above the boiling point of water, hydrogenating said remaining evolved gases, and cooling said hydrogenated gases to ambient temperature to condense water vapor and other lighter crude oils.

4. The process described in claim 1, wherein recovering the remaining evolved gases includes separating any remaining liquid and particulate matter from the remaining gas, and compressing said remaining gas to a volume suitable for storage and delivery for consumption.

5. The process described in claim 3, further including the steps of storing said heavy crude oils and said lighter crude oils, and cracking said crude oils after accumulating a predetermined quantity to produce the desired derivative products from said crude oils such as aromatics, kerosene, oxygen, hydrogen, waste water and others.

6. The process described in claim 1, wherein said step of continuously supplying shredded materials includes moving said shredded waste material along a sealed conveyor preheating said shredded material to increase the efficiency of the pyrolysis of said material in said sealed distillator compartment, controlling the temperature of said shredded material during said preheating below the boiling point of water to prevent vaporization of water outside said distillator compartment.

7. The process described in claim 6, wherein said step of continuously supplying shredded materials further includes recycling at least a portion of said condensed petroleum to spray on said shredded material to increase the amount of fuel gas which evolves when said waste material and said recycled petroleum undergo pyrolysis in said sealed distillator compartment.

8. The process described in claim 1, wherein the step of continuously moving said shredded material through said distillator compartment includes placing said shredded material on a generally horizontal first conveyor within said distillator compartment, dumping said shredded material to at least a second generally horizontal conveyor superposed below said first conveyor after passing along said first conveyor to agitate said shredded material for more complete pyrolysis, depositing the carbonaceous material remaining after pyrolysis in said distillator compartment for removal, and spraying said deposited carbonaceous material with water to further gasify said carbonaceous material and increase the quantity of fuel gases evolved.

9. The process described in claim 1, wherein said heating step includes heating a plurality of generally horizontal conveyors vertically arranged to move said waste material through said distillator compartment, and maintaining a preselected temperature range at the vertical location of each of said conveyors, said temperature ranges selected to maximize pyrolysis of said waste material.

10. A process for destructive distillation at atmospheric pressure of waste material containing organic matter and recovery of useful products therefrom, comprising the steps of shredding the waste material into pieces of predetermined size, for efficient pyrolysis, moving said shredded waste material along a sealed loading conveyor, preheating said shredded material in said loading conveyor to increase the efficiency of the pyrolysis of said material in said sealed distillator compartment, controlling the temperature of said shredded material during said preheating below the boiling point of water to prevent vaporization of water outside said distillator compartment, distributing said shredded material after delivery for said loading conveyor to a uniform predetermined depth on a generally horizontal first conveyor for movement through said distillator compartment, moving said shredded material on said first conveyor within said distillator compartment, dumping said shredded material on to at least a second generally horizontal conveyor superposed below said first conveyor after passing along said first conveyor to agitate said shredded material for more complete pyrolysis, uniformly heating along the path of each of said plurality of generally horizontal conveyors vertically arranged to move said waste material through said distillator compartment, controlling the temperature at about 650° F at said first conveyor vertical level and at selectively increasing temperatures to about 1000° F at a lowest vertical level, pyrolyzing said continuously moving materials for evolving volatile gases and vapors from said organic matter in said waste material, depositing the carbonaceous material remaining after pyrolysis in said distillator compartment for removal, spraying said deposited carbonaceous material with water to further gasify said carbonaceous material and increase the quantity of fuel gases evolved, continuously discharging the solid residue of said pyrolyzed organic waste materials from said sealed distillator compartment, continuously removing said evolved gases and vapors from said sealed distillator compartment, maintaining said distillator and said evolved gases at atmospheric pressure, recycling at least a portion of said condensed petroleum to spray on said shredded material while on said loading conveyor to increase the amount of fuel gas which evolves when said waste material and said recycled petroleum undergo pyrolysis in said sealed distillator compartment, cooling said removed gases for condensing a portion of said gases into liquid petroleum products and water, recovering said condensed water and liquid petroleum products, separating any remaining liquid and particulate matter from the remaining gases, and compressing said remaining gas to a volume suitable for storage and delivery for consumption.

11. The process described in claim 10, further including the steps of shredding said solid residue as said residue is continuously discharged from said sealed distillator compartment, removing charcoal and other light particulate material from said solid residue, passing the remaining residue through a magnetic field to remove ferrous metals, and collecting the remaining non-ferrous aggregate at the end of said process.

12. The process described in claim 10, wherein said cooling step includes cooling said evolved gases to condense heavy crude oils while maintaining the gases at a temperature above the boiling point of water, hydrogenating said remaining evolved gases, and cooling said hydrogenated gases to ambient temperature to condense water vapor and other lighter crude oils.

13. Apparatus for destructive distillation of waste materials containing organic matter, comprising grinding means for shredding the organic waste materials into pieces of predetermined size, a thermally insulated and atmospherically sealed distillator compartment for pyrolyzing said materials, loading means for continuously supplying said materials to said sealed distillator compartment at a predetermined rate while maintaining said atmospheric seal of said distillator compartment, distributing means for distributing said materials on a conveyor means to a predetermined uniform depth for effecting maximum heat transfer during movement of said materials through said distillator compartment for pyrolyzing said materials in said distillator compartment and evolving volatile gases and vapors, conveyor means disposed in said distillator compartment for receiving and continuously moving said materials through said distillator compartment at a predetermined rate and generally arranged for horizontal movement at a plurality of vertical levels within said distillator compartment, heating means for controllably heating and maintaining along the path of each of said horizontal conveyors to maintain a preselected temperature at each of said vertical levels sufficient to pyrolyze said materials, discharge means for continuously discharging the solid residue of said pyrolyzed material from said sealed distillator compartment while maintaining said atmospheric seal of said distillator compartment, separating means receiving the output from said discharge means for recovering charcoal and other carbonaceous products, ferrous metals and other aggregate from said solid residue, pipe means for collecting the gases evolving from said waste materia during pyrolysis in said sealed distillator compartment, and distillation means connected with said pipe means for separating said evolved gases into useful constituents.

14. The apparatus as described in claim 13, wherein said discharge means comprises a hopper disposed in said distillator compartment for receiving said solid residue from said conveyor means, an auger type conveyor to receive said residue from said hopper and remove said solid residue therefrom, and a discharge section to receive said solid residue while maintaining said atmospheric seal of said distillator compartment and opening to said separator means.

15. The apparatus as described in claim 14, wherein said discharge section comprises a generally cylindrical section which receives said solid residue from said auger and forms a generally solid plug of said residue to seal said distillator compartment, stabilizing bars disposed within said cylindrical section to engage said solid residue and prevent said plug from rotating within said cylindrical section, and a rotating cutter to engage said plug of solid residue for shredding said solid residue during discharge to said separating means.

16. The apparatus as described in claim 13, wherein said separating means comprises a mill to receive the shredded solid residue from said discharge section and further reduce the particulate size of said solid residue, a conveyor means to receive said solid residue from said mill for further processing, vacuum means disposed above said conveyor to separate light particulate matter including charcoal and dust from said residue, magnet means further disposed above said conveyor for attracting and separating ferrous metals from said solid residue, and collection means disposed at the end of said conveyor for receiving the remaining non-ferrous particulate aggregate.

17. The apparatus as described in claim 13, wherein said distillation means further comprises a first settling tank connected to said collection pipe means and atmospherically sealed for cooling said evolved gases to condense heavy crude oil, a second settling tank atmospherically sealed to receive gaseous products not condensed in said first settling tank for condensing the water and remaining light crude oils in said evolved gases, means connecting said first and second settling tanks, means for controlling the temperatures in said first and second settling tanks within predetermined temperature ranges to condense said heavy crude oil in said first tank and said light crude oil and water in said second tank, and means connected to said second settling tank for collecting and compressing non-condensible gases remaining from said second settling tank for distribution as fuel gas.

18. The apparatus as described in claim 17, wherein said temperature control means further comprises temperature sensing means within said first and second settling tanks, fan means connected with said non-condensible gas collecting means for recirculating said non-condensible gases back to said first and second settling tanks for colling said tanks, means connecting said fan with said first and second settling tanks, and control means responsive to said temperature sensing means and actuating said fan means to maintain the temperatures within said first and second settling tanks within a predetermined range.

19. The apparatus as described in claim 18, further including catalyst means interconnecting said first settling tank with said second settling tank for hydrogenating at atmospheric pressure said evolved gases that remain after condensation of said heavy crude oil.

20. The apparatus as described in claim 19, further including storage means connected with said first and second settling tanks for said condensed heavy and light crude oils, and cracking means selectively connectable to said storage means for recovery of useful constituents from said crude oils such as aromatics, including gasoline, benzene and alcohol, hydrogen, oxygen, waste water, kerosene, diesel and others, said cracking means being activated when a predetermined amount of said crude oils have been accumulated within said storage means.

21. The apparatus as described in claim 17, wherein said loading means further comprises conveyor means to move said shredded waste materials between said grinding means and said distributing means, means for preheating said shredded waste material on said conveyor means prior to distribution in said distillator compartment and to increase the efficiency of pyrolysis, and means connected to said first settling tank for recycling a portion of said crude oil to said waste material prior to said waste material entering said distillator compartment to improve the yield of fuel gas constituents in the gases evolved during pyrolysis of said waste material.

22. The apparatus as described in claim 21, wherein said preheating means further comprises a heating chamber contacting said loading conveyor to preheat said waste material on said conveyor, fan means interconnecting said heating chamber and said distillator compartment heating means to direct hot exhaust air through said heating chamber, temperature sensing means for ascertaining the temperature of said preheated waste material, and control means responsive to said temperature sensing means and actuating said fan means to maintain the temperature of said waste material within a predetermined range.

23. The apparatus as described in claim 13, wherein said distribution means further comprises intake auger means sealing said distillator compartment during continuous intake of said waste material from said loading means to said conveyor means within said distillator compartment, and a breaker bar arranged at a predetermined height above said conveyor means to maintain a uniform thickness of said waste material after passing under said breaker bar.

24. The apparatus as described in claim 13, wherein each unit of said conveyor means comprises a chain link conveyor belt for carrying and agitating said shredded waste material, a first end adapted to receive said shredded waste material, a second end adapted to discharge said shredded waste material, drive means, a drive sprocket interconnecting said drive means and said chain link conveyor belt for moving said waste material within said distillator compartment, and at least one idler gear supporting said chain link conveyor belt as said conveyor belt moves said waste material from said first end to said second end of said conveyor.

25. The apparatus as described in claim 24, wherein said heating means comprises means for applying heat along each of said conveyors at preselected vertical levels within said distillator compartment, means for sensing the temperature at each of said preselected vertical levels, and control means responsive to said temperature sensing means and actuating conveyor heat distriubtion means at each vertical level to maintain the temperature at said vertical level within preselected temperature ranges to obtain maximum pyrolysis of said waste material.

26. The apparatus as described in claim 25, wherein said conveyor heating means comprises burner means for heating air to a temperature sufficient to pyrolyze said waste material, a plurality of hot air ducts communicating with said burner means and disposed in horizontal rows beneath each said chain link conveyor belt portion carrying said waste material, and a conveyor pan spaced between and contacting said hot air ducts and said chain link conveyor to evenly distribute heat to said waste material.

27. The apparatus as described in claim 25, wherein said conveyor heating means comprises burner means for heating air to a temperature sufficient to pyrolyze said waste material, an elongated box disposed within the circumference of each chain link conveyor belt and contacting said chain link conveyor belt to evenly distribute heat to said waste material carried thereon, and pipe means interconnecting said burner means and said elongated box for carrying heated air therebetween.

28. In a system for continuous destructive distillation of waste material by pyrolysis, including a continuous shredder and distillator loading conveyor, a continuous discharge auger, means for recovering valuable products from a solid residue and a distillation system for collection and distillation of evolved gases into useful constituents, an improved pyrolysis chamber, wherein the improvement comprises a thermally insulated and atmospherically sealed distillator compartment, a plurality of generally horizontal chain-link conveyors arranged in superposed vertical levels within said distillator compartment for carrying said agitating shredded waste material, distributing means for distributing said materials on said chain-link conveyor to a predetermined uniform depth for effecting maximum heat transfer during movement of said materials through said compartment;

means for applying heat adjacent each of said conveyors at preselected vertical levels within said distillator compartment, means for sensing the temperature at each of said preselected vertical levels, and control means responsive to said temperature sensing means and actuating conveyor heat distribution means at each vertical level to maintain the temperature at said vertical level within preselected temperature ranges to obtain maximum pyrolysis of said waste material.

29. The improved pyrolysis chamber described in claim 28, wherein said conveyor heating means comprises burner means for heating air to a temperature sufficient to pyrolyze said waste material, a plurality of hot air ducts communicating with said burner means and disposed in horizontal rows beneath each said chain-link conveyor belt portion carrying said waste material, and a conveyor pan spaced between and contacting said hot air ducts and said chain-link conveyor to evenly distribute heat to said waste material.

30. The improved pyrolysis chamber described in claim 28, wherein said conveyor heating means comprises burner means for heating air to a temperature sufficient to pyrolyze said waste material, an elongated box disposed within the circumference of each chain-link conveyor belt and contacting said chain-link conveyor belt to evenly distribute heat to said waste material carried thereon, and pipe means interconnecting said burner means and said elongated box for carrying heated air therebetween.

* * * * *

UNITED STATES PATENT AND TRADEMARK OFFICE

CERTIFICATE OF CORRECTION

PATENT NO. : 4,038,152

DATED : July 26, 1977

INVENTOR(S) : Lyle D. Atkins

It is certified that error appears in the above-identified patent and that said Letters Patent are hereby corrected as shown below:

Col. 3, line 13, insert "vertical" before "cross-sectional";

Col. 5, line 57, change "III" to --111--;

Col. 6, line 15, change "III" to --111--;

Col. 11, line 53, change "emobdiment" to --embodiment--;

Col. 13, line 6, change "ncrease" to --increase--;

Col. 14, line 33, after "graphite" insert --grease--;

Col. 15, line 24, change "216" to --217--;

Col. 16, line 38, change "predeterminded" to --predetermined--;

Col. 18, line 44, change "for" to --by--;

Col. 20, line 16, change "materia" to --material--;

Col. 21, line 20, change "colling" to --cooling--;

Col. 22, line 39, change "distriubtion" to --distribution--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*